US011081789B2

(12) United States Patent
Ding et al.

(10) Patent No.: US 11,081,789 B2
(45) Date of Patent: Aug. 3, 2021

(54) BASE STATION ANTENNAS INCLUDING WIPER PHASE SHIFTERS

(71) Applicant: CommScope Technologies LLC, Hickory, NC (US)

(72) Inventors: Guomin Ding, Suzhou (CN); Martin Zimmerman, Chicago, IL (US); Junfeng Yu, Suzhou (CN); Haifei Qin, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 98 days.

(21) Appl. No.: 16/450,005

(22) Filed: Jun. 24, 2019

(65) Prior Publication Data

US 2020/0006848 A1 Jan. 2, 2020

(30) Foreign Application Priority Data

Jun. 29, 2018 (CN) ..... 201810692241.5

(51) Int. Cl.

| | |
|---|---|
| ***H01Q 3/32*** | (2006.01) |
| ***H01Q 1/24*** | (2006.01) |
| ***H01Q 1/38*** | (2006.01) |

(52) U.S. Cl.

CPC ..... *H01Q 3/32* (2013.01); *H01Q 1/246* (2013.01); *H01Q 1/38* (2013.01)

(58) Field of Classification Search

CPC ..... H01Q 3/30; H01Q 3/32; H01Q 1/246; H01Q 1/38; H01Q 21/0006

See application file for complete search history.

(56) References Cited

U.S. PATENT DOCUMENTS 5,798,675 A 8/1998 Drach
7,170,466 B2 * 1/2007 Janoschka ..... H01P 1/184 333/156

(Continued)

FOREIGN PATENT DOCUMENTS

GB 2384369 A * 7/2003 ..... H01Q 3/30
GB 2384369 A 7/2003

(Continued)

OTHER PUBLICATIONS

Extended European Search Report corresponding to European Application No. 19182911.8 (dated Sep. 19, 2019).

*Primary Examiner* — Dimary S Lopez Cruz
*Assistant Examiner* — Patrick R Holecek
(74) *Attorney, Agent, or Firm* — Myers Bigel, P.A.

(57) ABSTRACT

Base station antennas are provided herein. A base station antenna includes first and second wiper phase shifters. In some embodiments, the base station antenna includes first and second wiper supports that are on the first and second wiper phase shifters, respectively, and the first wiper support includes a portion that is beside and interlocked with a portion of the second wiper support. In some embodiments, the base station antenna includes a first linkage that is on the second wiper phase shifter, and a second linkage that intersects, and is coupled to, the first linkage and is configured to adjust the first and second wiper phase shifters via the first linkage. In some embodiments, the first and second wiper phase shifters are a mirror-image pair of wiper phase shifters. Related methods of operating a base station antenna are also provided.

14 Claims, 14 Drawing Sheets

(56) References Cited

U.S. PATENT DOCUMENTS

| | | | | |
|---|---|---|---|---|
| 7,233,217 | B2 * | 6/2007 | Phillips | H01P 1/184 333/116 |
| 7,358,922 | B2 * | 4/2008 | Le | H01Q 1/246 343/797 |
| 7,907,096 | B2 | 3/2011 | Timofeev et al. | |
| 2005/0046514 | A1 | 3/2005 | Janoschka | |
| 2018/0287255 | A1 | 10/2018 | Zimmerman | |
| 2020/0321697 | A1 * | 10/2020 | Zimmerman | H01Q 1/246 |

FOREIGN PATENT DOCUMENTS

| | | | |
|---|---|---|---|
| WO | 03/019720 | A1 | 3/2003 |
| WO | 2017/165512 | | 9/2017 |
| WO | 2017/218396 | A1 | 12/2017 |

* cited by examiner

BASE STATION ANTENNAS INCLUDING WIPER PHASE SHIFTERS

CROSS-REFERENCE TO RELATED APPLICATION

The present application claims priority to Chinese Patent Application No. 201810692241.5, filed Jun. 29, 2018, the entire content of which is incorporated herein by reference.

FIELD

The present disclosure relates to communication systems and, in particular, to phase shifters for base station antennas.

BACKGROUND

Base station antennas for wireless communication systems are used to transmit Radio Frequency (RF) signals to, and receive RF signals from, fixed and mobile users of a cellular communications service. Base station antennas often include a linear array or a two-dimensional array of radiating elements such as dipole, or crossed dipole, radiating elements. To change the down tilt angle of the antenna beam generated by an array of radiating elements, a phase taper may be applied across the radiating elements. Such a phase taper may be applied by adjusting the settings on an adjustable phase shifter that is positioned along an RF transmission path between a radio and the individual radiating elements of the base station antenna.

One known type of phase shifter is an electromechanical rotating "wiper" arc phase shifter that includes a main Printed Circuit Board (PCB) and a "wiper" PCB that may be rotated above the main PCB. Such a rotating wiper arc phase shifter typically divides an input RF signal that is received at the main PCB into a plurality of sub-components, and then capacitively couples at least some of these sub-components to the wiper PCB. These sub-components of the RF signal may be capacitively coupled from the wiper PCB back to the main PCB along a plurality of arc-shaped traces, where each arc has a different radius. Each end of each arc-shaped trace may be connected to a radiating element or to a sub-group of radiating elements. By physically rotating the wiper PCB above the main PCB, the location where the sub-components of the RF signal capacitively couple back to the main PCB may be changed, thereby changing the path lengths that the sub-components of the RF signal traverse when passing from a radio to the radiating elements. These changes in the path lengths result in changes in the phases of the respective sub-components of the RF signal, and because the arcs have different radii, the change in phase experienced along each path differs.

Typically, the phase taper is applied by applying positive phase shifts of various magnitudes (e.g., +X°, +2X° and +3X°) to some of the sub-components of the RF signal and by applying negative phase shifts of the same magnitudes (e.g., −X°, −2X° and −3X°) to additional of the sub-components of the RF signal. Thus, the above-described rotary wiper arc phase shifter may be used to apply a phase taper to the sub-components of an RF signal that are transmitted through the respective radiating elements (or sub-groups of radiating elements). Example phase shifters of this variety are discussed in U.S. Pat. No. 7,907,096 to Timofeev, the disclosure of which is hereby incorporated herein by reference in its entirety. The wiper PCB is typically moved using an actuator that includes a Direct Current (DC) motor that is connected to the wiper PCB via a mechanical linkage. These actuators are often referred to as "RET" actuators because they are used to apply the remote electronic down tilt.

SUMMARY

A base station antenna, according to some embodiments herein, may include a first wiper phase shifter, and a second wiper phase shifter that is beside the first wiper phase shifter. Moreover, the base station antenna may include first and second wiper supports on the first and second wiper phase shifters, respectively. The first wiper support may include a portion that is beside and interlocked with a portion of the second wiper support.

In some embodiments, the portion of the first wiper support and the portion of the second wiper support may include first and second pluralities of gear teeth, respectively. A portion of the first plurality of gear teeth may be interlocked with a portion of the second plurality of gear teeth. The first and second pluralities of gear teeth may be on first and second curved surfaces, respectively, of the first and second wiper supports. Moreover, the first and second pluralities of gear teeth may extend less than 360 degrees around the first and second wiper supports, respectively. Additionally or alternatively, the first wiper support may include a built-in lever linkage portion that protrudes beyond the first plurality of gear teeth.

According to some embodiments, the base station antenna may include a third wiper phase shifter, and a fourth wiper phase shifter that is beside the third wiper phase shifter. The base station antenna may include third and fourth wiper supports on the third and fourth wiper phase shifters, respectively. The third wiper support may be beside and non-interlocking with the fourth wiper support. The first and second wiper supports may overlap the third and fourth wiper supports, respectively.

In some embodiments, the base station antenna may include a metal structure including different first and second levels. The first and second wiper phase shifters may be on the first level, and the third and fourth wiper phase shifters may be on the second level. The base station antenna may include a fifth wiper phase shifter on the first level, and a fifth wiper support on the fifth wiper phase shifter. The base station antenna may include a first linkage overlapping the second and fifth wiper phase shifters. The base station antenna may include a second linkage that connects the first wiper support to the first linkage. Moreover, the base station antenna may include a third linkage that is connected to, and configured to control movement of, the first linkage.

According to some embodiments, the base station antenna may include a sixth wiper phase shifter on the first level. The base station antenna may include a sixth wiper support on the sixth wiper phase shifter. The sixth wiper support may include a portion that is beside and interlocked with a portion of the fifth wiper support. Moreover, the base station antenna may include a fourth linkage that connects the sixth wiper support to the first linkage. The second and fifth wiper phase shifters may be between the first and sixth wiper phase shifters.

In some embodiments, the base station antenna may include a seventh wiper phase shifter, and an eighth wiper phase shifter that is beside the seventh wiper phase shifter on the second level. The base station antenna may include seventh and eighth wiper supports on the seventh and eighth wiper phase shifters, respectively. The seventh wiper support may be beside and non-interlocking with the eighth wiper support. The fifth and sixth wiper supports may overlap the seventh and eighth wiper supports, respectively.

According to some embodiments, the base station antenna may include a main Printed Circuit Board (PCB) having a Radio Frequency (RF) transmission line thereon. The first and second wiper phase shifters may include first and second wiper PCBs, respectively, that are mirror images of each other. Moreover, the main PCB may be part of at least one of the first wiper phase shifter or the second wiper phase shifter.

A base station antenna, according to some embodiments herein, may include a first wiper phase shifter, and a second wiper phase shifter that is coupled to the first wiper phase shifter. The base station antenna may include a third wiper phase shifter. The base station antenna may include a first linkage that is on the second and third wiper phase shifters. Moreover, the base station antenna may include a second linkage that intersects, and is coupled to, the first linkage and is configured to adjust the first, second, and third wiper phase shifters via the first linkage.

In some embodiments, the first and second wiper phase shifters may be a mirror-image pair of wiper phase shifters. The second wiper phase shifter may be between the first wiper phase shifter and the third wiper phase shifter. Moreover, the base station antenna include first, second, and third wiper supports on the first, second, and third wiper phase shifters, respectively. The first wiper phase shifter may be coupled to the second wiper phase shifter via the first and second wiper supports.

According to some embodiments, the base station antenna may include a fourth wiper phase shifter that is beside the third wiper phase shifter. The base station antenna may include a metal structure including a first level that includes the first, second, third, and fourth wiper phase shifters. The base station antenna may include fifth, sixth, seventh, and eighth wiper phase shifters on a second level of the metal structure. The first level may overlap the second level. The base station antenna may include fourth, fifth, sixth, seventh, and eighth wiper supports on the fourth, fifth, sixth, seventh, and eighth wiper phase shifters, respectively. The second linkage may be configured to adjust the first, second, third, fourth, fifth, sixth, seventh, and eighth wiper phase shifters by driving the first linkage.

In some embodiments, the base station antenna may include a third linkage that couples the first wiper support to the first linkage. Moreover, the base station antenna may include a fourth linkage that couples the fourth wiper support to the first linkage. The second and third wiper phase shifters may be between the first and fourth wiper phase shifters.

According to some embodiments, the first linkage may be a slotted linkage, and a portion of the second linkage may be in a slot of the slotted linkage. Moreover, the sixth wiper support may include a protruding pin that is in a slot of the second wiper support.

In some embodiments, the slotted linkage may be a multi-level slotted linkage that includes a first portion on the first level and a second portion on the second level. The second portion may be on the sixth and seventh wiper phase shifters, and the slot of the slotted linkage may be between the first and second portions.

According to some embodiments, the first, second, third, and fourth wiper supports may include first, second, third, and fourth pluralities of gear teeth, respectively. A portion of the first plurality of gear teeth may be interlocked with a portion of the second plurality of gear teeth, and a portion of the third plurality of gear teeth may be interlocked with a portion of the fourth plurality of gear teeth. The fifth wiper support may be beside and non-interlocking with the sixth wiper support, and the seventh wiper support may be beside and non-interlocking with the eighth wiper support.

A base station antenna, according to some embodiments herein, may include a mirror-image pair of wiper phase shifters that includes a first wiper phase shifter and a second wiper phase shifter. The base station antenna may include a first linkage that is on the second wiper phase shifter. The base station antenna may include a second linkage that couples the first wiper phase shifter to the first linkage. Moreover, the base station antenna may include a third linkage that is coupled to, and configured to drive, the first linkage.

In some embodiments, the base station antenna may include first and second wiper supports on the first and second wiper phase shifters, respectively. The first wiper phase shifter may be coupled to the second linkage via the first wiper support. Moreover, the second linkage and the first wiper support may, in some embodiments, be a single part.

According to some embodiments, the base station antenna may include a third wiper phase shifter. The first linkage may be on the third wiper phase shifter. The base station antenna may include a third wiper support on the third wiper phase shifter. The base station antenna may include a fourth wiper phase shifter. The base station antenna may include a fourth wiper support on the fourth wiper phase shifter. Moreover, the base station antenna may include a fourth linkage that couples the fourth wiper support to the first linkage. The second and third wiper phase shifters may be between the first and fourth wiper phase shifters.

In some embodiments, the base station antenna may include a metal structure including a first level that includes the first, second, third, and fourth wiper phase shifters. The base station antenna may include fifth, sixth, seventh, and eighth wiper phase shifters on a second level of the metal structure. The first level may overlap the second level. The base station antenna may include fifth, sixth, seventh, and eighth wiper supports on the fifth, sixth, seventh, and eighth wiper phase shifters, respectively. Moreover, the third linkage may be configured to adjust the first, second, third, fourth, fifth, sixth, seventh, and eighth wiper phase shifters by driving the first linkage.

According to some embodiments, the first, second, third, and fourth wiper supports may include first, second, third, and fourth pluralities of gear teeth, respectively. A portion of the first plurality of gear teeth may be interlocked with a portion of the second plurality of gear teeth, and a portion of the third plurality of gear teeth may be interlocked with a portion of the fourth plurality of gear teeth. The fifth wiper support may be beside and non-interlocking with the sixth wiper support, and the seventh wiper support may be beside and non-interlocking with the eighth wiper support. Additionally or alternatively, the second linkage may be a lever linkage that is configured to drive rotational movement of the second wiper support by driving rotational movement of the first wiper support, the base station antenna is configured to operate using one or more frequencies in a range of 2.0 gigahertz (GHz) to 4.2 GHz, and a longest dimension of the metal structure may be 220 millimeters or smaller. In some embodiments, the base station antenna is configured to operate using one or more frequencies lower than 2.0 GHz and/or one or more frequencies higher than 4.2 GHz.

A method of operating a base station antenna, according to some embodiments herein, may include driving rotational movement of a first plurality of phase shifter wiper supports of a plurality of inboard phase shifters, respectively, of a phase shifter assembly by driving rotational movement of a second plurality of phase shifter wiper supports of a plurality of outboard phase shifters, respectively, of the phase shifter assembly. In some embodiments, the driving the rotational movement of the second plurality of phase shifter wiper supports may include driving a plurality of lever linkages that connect the second plurality of phase shifter wiper supports, respectively, to a slotted linkage of the phase shifter assembly. Moreover, in some embodiments, the driving the plurality of lever linkages may include driving the slotted linkage by operating a motor to drive a driving linkage that is connected to the slotted linkage.

DETAILED DESCRIPTION

Pursuant to embodiments of the present inventive concepts, base station antennas are provided that have phase shifter assemblies. Each phase shifter assembly may include a mirror-image arrangement of phase shifters that includes one or more pairs of mirror-image phase shifters. By arranging the phase shifters as pairs of mirror-image phase shifters, spacing between the phase shifters may be relatively tight, and the phase shifter assembly may thus have a relatively compact structure. A pair of mirror-image phase shifters may also have interlocking supports so that one of the phase shifters in the pair can drive the other phase shifter in the pair. Moreover, a linkage, such as a lever arm, may connect a distal phase shifter to a central linkage that is driven by a drive (or "driving") linkage. This may reduce force and increase accuracy when performing a phase shift. High accuracy movements may be particularly beneficial for small phase shifters, as adjusting small phase shifters may involve making small rotational movements at the phase shifters. Additionally or alternatively, a base station antenna pursuant to embodiments herein may include multiple layers of phase shifters that are driven as a group by a single drive linkage (rather than multiple drive linkages), thus improving the compactness of the phase shifter assembly and reducing the number of parts.

Example embodiments of the present inventive concepts will be described in greater detail with reference to the attached figures.

Figure 1A:
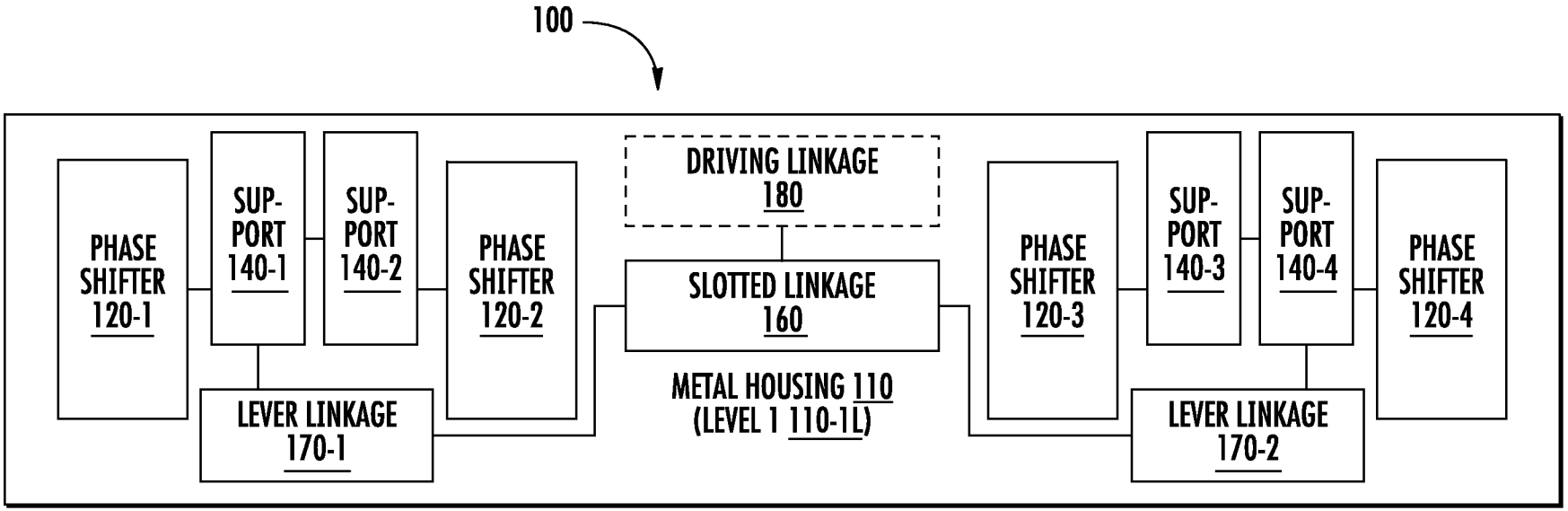
FIG. 1A is a schematic block diagram of a phase shifter assembly for a base station antenna that includes a plurality of individual phase shifters on a first level of a metal housing according to embodiments of the present inventive concepts.
Figure 2A:
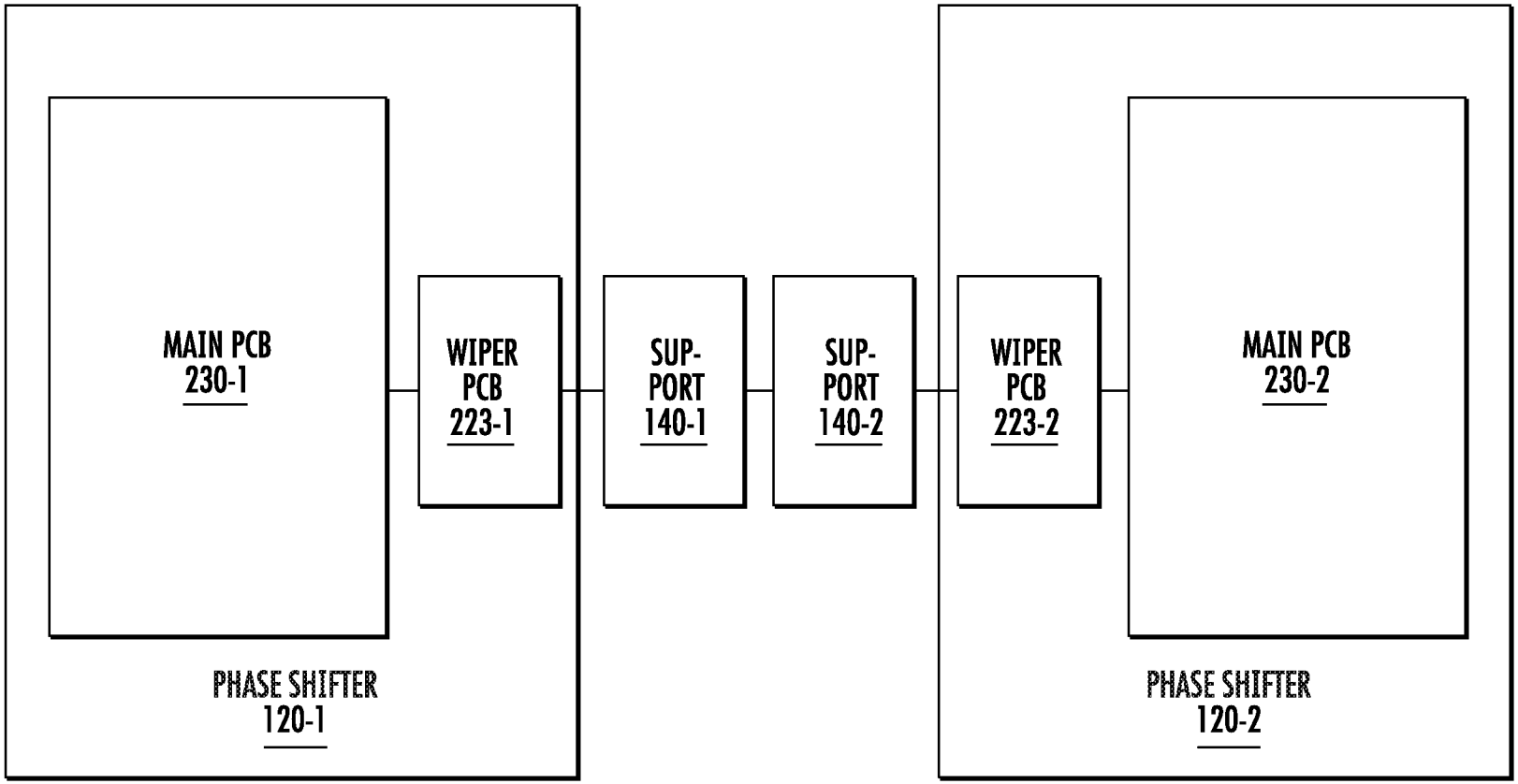
FIGS. 2A and 2B are schematic block diagrams of two wiper phase shifters that are coupled to each other via respective wiper supports according to embodiments of the present inventive concepts.
Figure 2B:
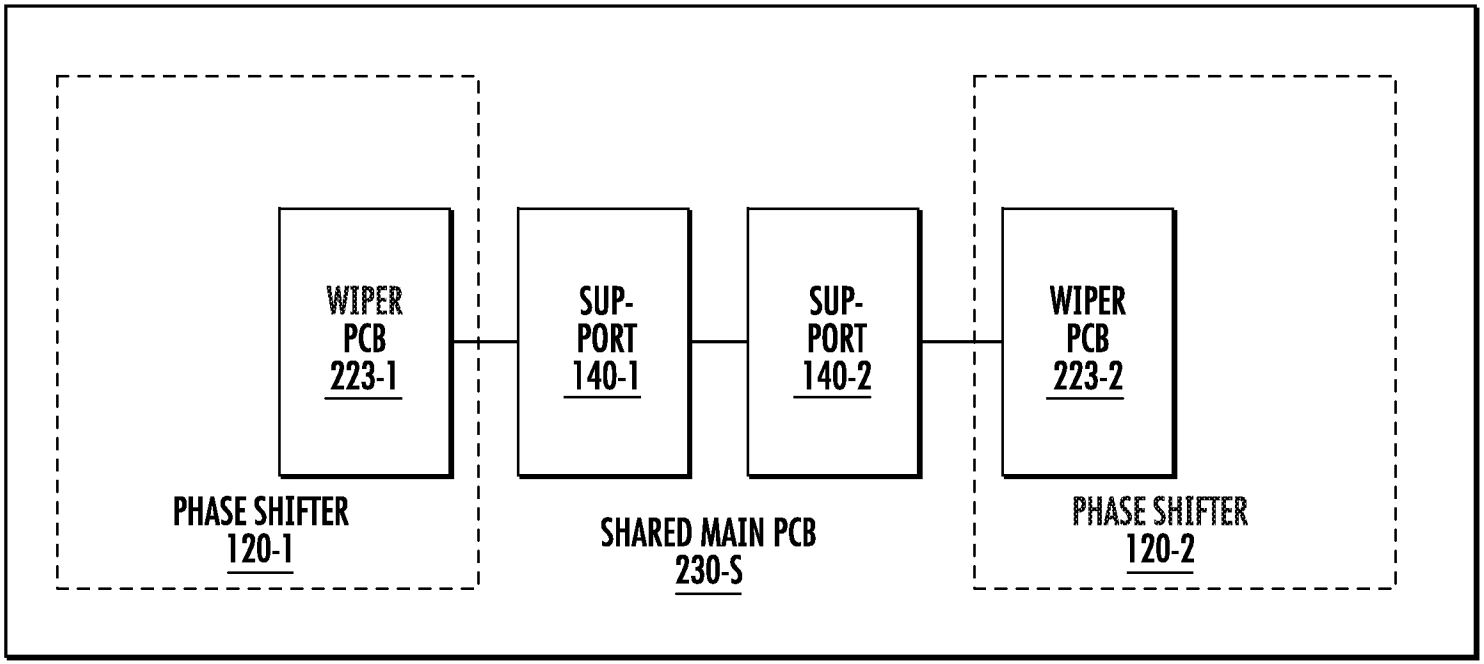
Figure 2C:
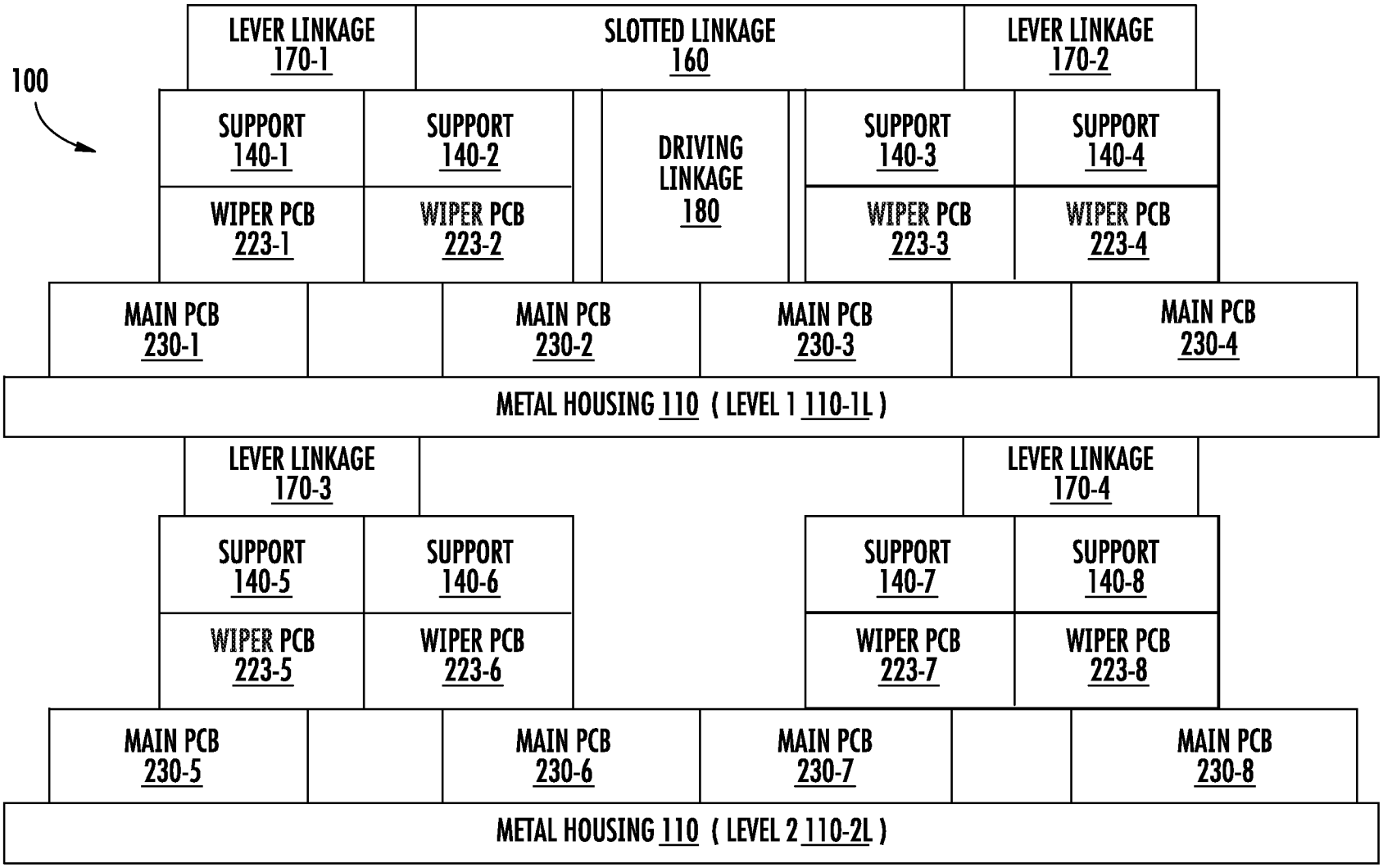
FIG. 2C is a schematic cross-sectional view of a phase shifter assembly for a base station antenna according to embodiments of the present inventive concepts.

FIG. 1A is a schematic block diagram of a phase shifter assembly 100 for a base station antenna that includes a plurality of individual phase shifters 120 on a first level 110-1L of a housing/structure (e.g., a metal housing/structure) 110 according to embodiments of the present inventive concepts. The individual phase shifters 120 may be collinear on the first level 110-1L of the housing 110, and thus may be referred to herein as a "linear array." Each individual phase shifter 120 may be a rotary wiper phase shifter that includes a stationary main PCB 230 and a movable/rotatable wiper PCB 223 (FIGS. 2A-2C). Although FIG. 1A provides an example in which four individual phase shifters 120 (120-1, 120-2, 120-3, and 120-4) are on the first level 110-1L of the housing 110, the first level 110-1L of the housing 110 may include more or fewer phase shifters 120. For example, the first level 110-1L may include two, three, five, six, seven, or more individual phase shifters 120.

The individual phase shifters 120 on the first level 110-1L may be arranged in pairs, where each individual phase shifter 120 of a pair is coupled to the other individual phase shifter 120 in the pair via phase shifter supports 140. For example, the phase shifters 120-1 and 120-2 may be a pair and may be coupled to each other via phase shifter supports 140-1 and 140-2. As another example, the phase shifters 120-3 and 120-4 may be a pair and may be coupled to each other via phase shifter supports 140-3 and 140-4. In particular, the phase shifter supports 140-1, 140-2, 140-3, and 140-4 may be on the phase shifters 120-1, 120-2, 120-3, and 120-4, respectively, where the phase shifter supports 140-1 and 140-2 are coupled to (e.g., interlocked with) each other and the phase shifter supports 140-3 and 140-4 are coupled to (e.g., interlocked with) each other. Moreover, as the phase shifters 120 may be wiper phase shifters that include a main PCB 230 and a wiper PCB 223 (FIGS. 2A-2C), the phase shifter supports 140 may be wiper phase shifter supports, which may be referred to herein as "wiper supports." In particular, the phase shifter supports 140 may be attached to the wiper PCBs 223 of the phase shifters 120.

FIG. 1A also illustrates that the phase shifter assembly 100 includes linkages 160, 170-1, 170-2, and 180. For example, the linkage 160, which may be a slotted linkage, may be on (e.g., may overlap) the phase shifters 120-2 and

120-3. Moreover, the linkage 180 may be a driving linkage that is connected to, and configured to control movement of (i.e., to drive), the linkage 160. Accordingly, the linkage 180 can adjust the phase shifters 120-1, 120-2, 120-3, and 120-4 collectively by moving the linkage 160. In particular, using the linkage 180 to drive movement of the linkage 160 results in rotational movement of the phase shifter supports 140-1 and 140-4, which further results in rotational movement of the phase shifter supports 140-2 and 140-3 that are coupled to (e.g., interlocked with) the phase shifter supports 140-1 and 140-4, respectively. As the phase shifters 120-1, 120-2, 120-3, and 120-4 have the phase shifter supports 140-1, 140-2, 140-3, and 140-4, respectively, thereon, rotational movement of the phase shifter supports 140-1, 140-2, 140-3, and 140-4 results in rotational movement of the phase shifters 120-1, 120-2, 120-3, and 120-4.

The linkage 160 may be coupled to the linkages 170-1 and 170-2. The linkages 170-1 and 170-2, which may be lever linkages, may connect the linkage 160 to outer/distal ones of the phase shifter supports 140. For example, the linkage 170-1 may connect the phase shifter support 140-1 to the linkage 160, and the linkage 170-2 may connect the phase shifter support 140-4 to the linkage 160. In some embodiments, the phase shifter supports 140-2 and 140-3 may not be directly connected to the linkages 170-1 and 170-2 (or to the linkage 160), but rather may be indirectly connected via the phase shifter supports 140-1 and 140-4, respectively. Respective pivot points/axes of the outer/distal phase shifter supports 140-1 and 140-4 may be at least 148 millimeters (mm) apart from each other, which allows sufficient room for the two linkages 170-1 and 170-2. By extending to connect to an outer/distal one of the phase shifter supports 140 (rather than an inner/proximal one of the phase shifter supports 140), each linkage 170 may be sufficiently long that the force used to move the linkage 170 is relatively low. The larger the arm of force, the lower the force that is required. The relatively long length of each linkage 170 may also reduce/prevent down tilt accuracy issues that may otherwise be driven by hysteresis in the linkage 170.

In some embodiments, the linkage 160 may be a slotted linkage that may include a plurality of slots on a plurality of levels. For example, the linkage 160 may include four slots and two levels, and thus may be configured to drive phase shifters 120 on a two-layer stack-up (e.g., on both of the levels 110-1L and 110-2L). Moreover, instead of using two linkages 180, a single linkage 180 may move the two layers/levels of phase shifters 120 in unison. The single linkage 180 may extend into a slot of the linkage 160 that is between the two levels of the linkage 160.

Regardless of whether the linkage 160 has a single level or multiple levels, the use of a single linkage 180 for the phase shifter assembly 100 may help to reduce hysteresis that may otherwise occur in phase shifter readings due to twisting/bending in a forked piece that converts a single shaft of an actuator into two parallel shafts (i.e., two of the linkages 180). The single linkage 180 may also help to reduce the overall size of the phase shifter assembly 100 relative to a design that includes the two parallel shafts, as the two parallel shafts may be about 160 mm apart from each other.

The linkage 180 may be a mechanical linkage (e.g., a shaft or rod, such as a square rod) that is connected to a motor, such as a DC motor, of the base station antenna. As an example, the linkage 180 may optionally include a worm gear. The motor may drive the linkage 180 to move linearly in response to rotation of the motor. Other portions of the linkage 180 may be connected to moving parts (e.g., wiper PCBs 223) so that movement of the linkage 180 results in an adjustment of a setting of the plurality of individual phase shifters 120 so that the phase shifters 120 apply more or less phase shift. For example, one end of the linkage 180 may be connected to a mechanical translator of an RET actuator, and the other end may be connected to the linkage 160. In this fashion, an external control signal received at a control input of the base station antenna may be used to change an electronic down tilt of an array of radiating elements.

Moreover, the linkage 180 may be configured to collectively/simultaneously shift each of the individual phase shifters 120 to adjust each of a plurality of different phase-shifted RF output values. Specifically, the output of each of the individual phase shifters 120 may be adjusted by the same amount (i.e., a common, uniform adjustment value). For example, linear movement of the linkage 180 may result in rotating each individual phase shifter 120 by the same amount.

As would be understood by a person skilled in the art, the phase shifter assembly 100 may be used in a base station antenna that includes radiating elements that are coupled to the phase shifter assembly 100. In particular, the base station antenna may include an array of radiating elements that receives a phase-shifted RF signal that is output by the plurality of individual phase shifters 120. In some embodiments, the plurality of individual phase shifters 120 may be configured to provide a plurality of different phase-shifted RF output values to the respective radiating elements or to respective groups of radiating elements.

The base station antenna may be a single-band or multi-band antenna. As an example, the base station antenna may operate using frequencies ranging from 2.0 gigahertz (GHz) to 4.2 GHz. Accordingly, embodiments of the present inventive concepts may operate using frequencies such as 2.5 GHz, 3.0 GHz, 3.4 GHz, 3.5 GHz, and/or 3.75 GHz. Additionally or alternatively, the base station antenna may operate using other frequencies between 2.0 GHz and 4.2 GHz or frequencies above or below this range.

The higher the frequency, the smaller the wavelength of an RF signal. Consequently, a fixed amount of movement of a movable/rotatable portion of a phase shifter will result in a larger phase change the higher the frequency of the RF signal. As such, errors in the amount of movement of a phase shifter due to, for example, tolerances, can result in greater deviation from a desired phase shift. Base station antennas may operate at a relatively high frequency (e.g., a central frequency of 3.75 GHz), and thus may benefit from higher accuracy on a linkage system that drives phase shifters of the antennas. If, however, components of the linkage system have significant hysteresis, then an antenna may not satisfy a specified +/−1 degree tilt tolerance. Accordingly, it may be desirable to provide a base station antenna having a linkage system that keeps the plurality of individual phase shifters 120 according to some embodiments herein synchronized, that reduces the push and pull force that is required to drive the phase shifters 120, and that improves transmission accuracy.

Examples of a base station antenna with a rotary wiper phase shifter coupled to an array of radiating elements are discussed in U.S. Patent Application No. 62/478,632 to Zimmerman and International Patent Application No. PCT/US2017/023582 to Bisiules, the disclosures of which are hereby incorporated herein by reference in their entireties. Moreover, the plurality of individual phase shifters 120 according to some embodiments herein may be a part of a feed network of the base station antenna, an input of which feed network may be connected to a radio such as a remote radio head.

Each sub-component of an input RF signal may be phase shifted a fixed or variable amount by the phase shifter assembly 100. In particular, different combinations of the individual phase shifters 120 apply phase tapers to the sub-components as they are fed to individual ones of the radiating elements in the base station antenna. Such phase tapers may be used to apply an electronic down tilt to the radiation pattern formed by an array (e.g., a vertical array) of the radiating elements. As an example, a first radiating element in a linear array of the base station antenna may have a phase of Y°+2X°, a second radiating element in the linear array may have a phase of Y°+X°, a third radiating element in the linear array may have a phase of Y°, a fourth radiating element in the linear array may have a phase of Y°−X°, and a fifth radiating element in the linear array may have a phase of Y°−2X°.

Figure 1B:
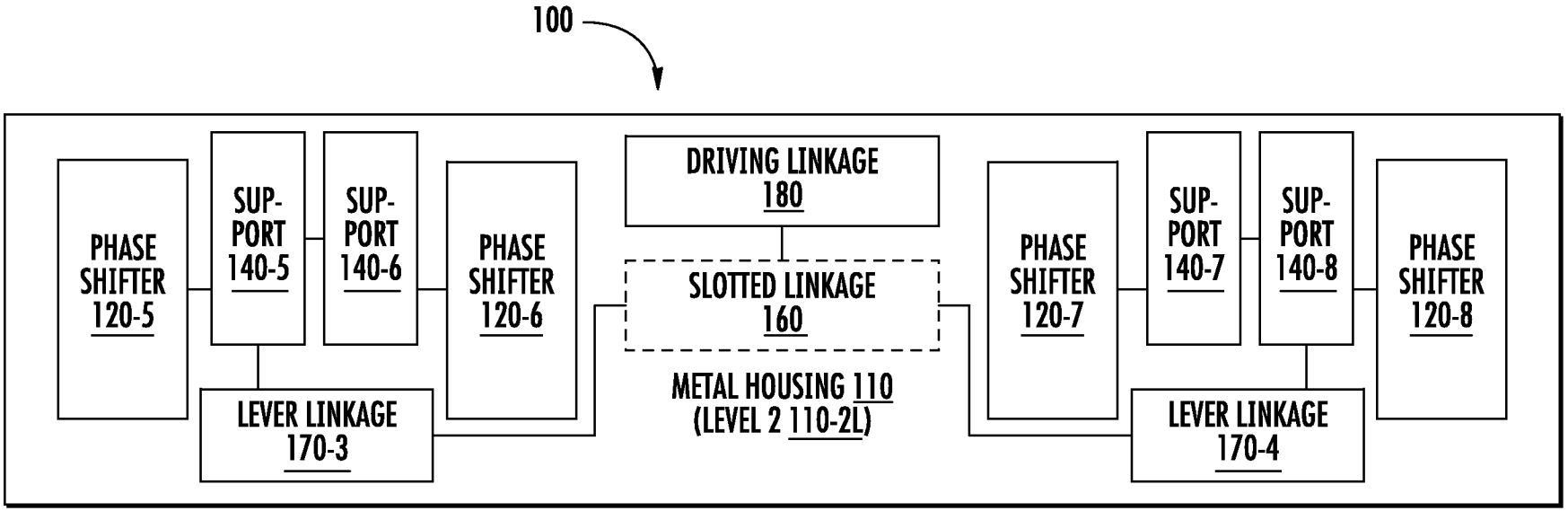
FIG. 1B is a schematic block diagram of a phase shifter assembly for a base station antenna that includes a plurality of individual phase shifters on a second level of a metal housing according to embodiments of the present inventive concepts.

FIG. 1B is a schematic block diagram of a phase shifter assembly 100 for a base station antenna that includes a plurality of individual phase shifters 120 on a second level 110-2L of a metal housing (or other structure) 100 according to embodiments of the present inventive concepts. As an example, the phase shifter assembly 100 may include four columns of phase shifters 120. In some embodiments, the first and second levels 110-1L and 110-2L of the housing/structure 110 may be provided by respective "phase plates" or "phase shifter plates." Elements on the second level 110-2L may be similar to those on the first level 110-1L, which may be above or below the second level 110-2L. For example, the second level 110-2L may include phase shifters 120-5, 120-6, 120-7, and 120-8, which may have phase shifter supports 140-5, 140-6, 140-7, and 140-8, respectively, thereon.

Moreover, a linkage 170-3 may connect the phase shifter support 140-5 to the linkage 160, and a linkage 170-4 may connect the phase shifter support 140-8 to the linkage 160. As an example, the linkages 170-3 and 170-4 may connect to portions (e.g., slots) of the linkage 160 that are on the first level 110-1L. Alternatively, portions of the linkage 160 may be on the second level 110-2L, and the linkages 170-3 and 170-4 may connect to the portions of the linkage 160 that are on the second level 110-2L. Similarly, the linkage 180 may connect to a portion of the linkage 160 that is on the first level 110-1L or to a portion of the linkage 160 that is on the second level 110-2L. Accordingly, in some embodiments, the linkage 160 and/or the linkage 180 may be on one of the first level 110-1L or the second level 110-2L and absent from the other of the first level 110-1L or the second level 110-2L.

The phase shifter supports 140-5, 140-6, 140-7, and 140-8, unlike the phase shifter supports 140-1, 140-2, 140-3, and 140-4 of the first level 110-1L, may be non-interlocking with each other in some embodiments. For example, although portions of the phase shifter supports 140-5 and 140-6 may face each other and portions of the phase shifter supports 140-7 and 140-8 may face each other, the portions that face each other may be free of gear teeth. Accordingly, the phase shifter supports 140-5, 140-6, 140-7, and 140-8 may be referred to as "non-geared."

Figure 1C:
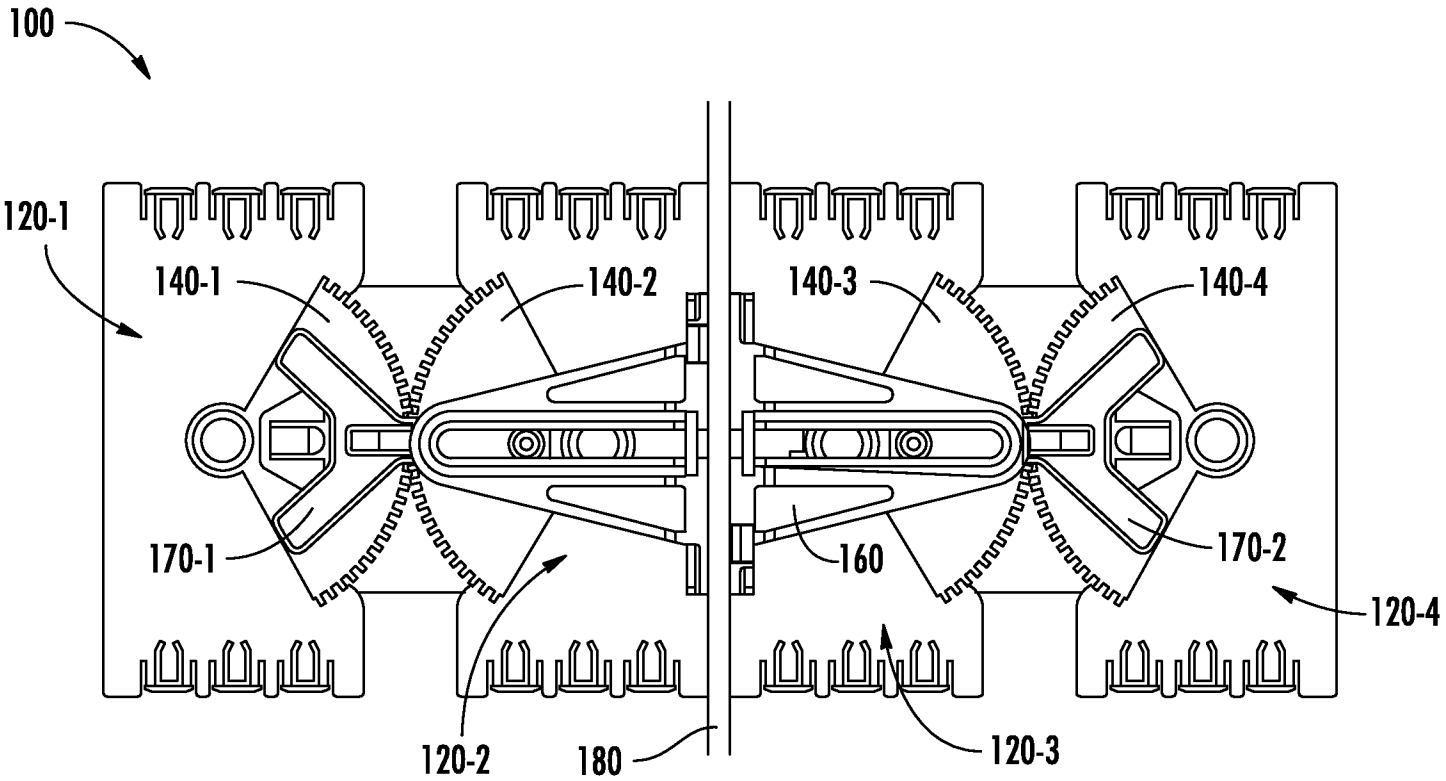
FIG. 1C is a schematic plan view of a phase shifter assembly for a base station antenna according to embodiments of the present inventive concepts.

FIG. 1C is a schematic plan view of a phase shifter assembly 100 for a base station antenna according to embodiments of the present inventive concepts. As illustrated in FIG. 1C, the linkage 180 may intersect (e.g., bisect) the linkage 160. FIG. 1C is also an example in which a portion of the phase shifter support 140-1 is beside and interlocked with a portion of the phase shifter support 140-2, and a portion of the phase shifter support 140-3 is beside and interlocked with a portion of the phase shifter support 140-4. Moreover, in the example of FIG. 1C, the linkages 170-1 and 170-2 connect the phase shifter supports 140-1 and 140-4, respectively, to the linkage 160.

Figure 1D:
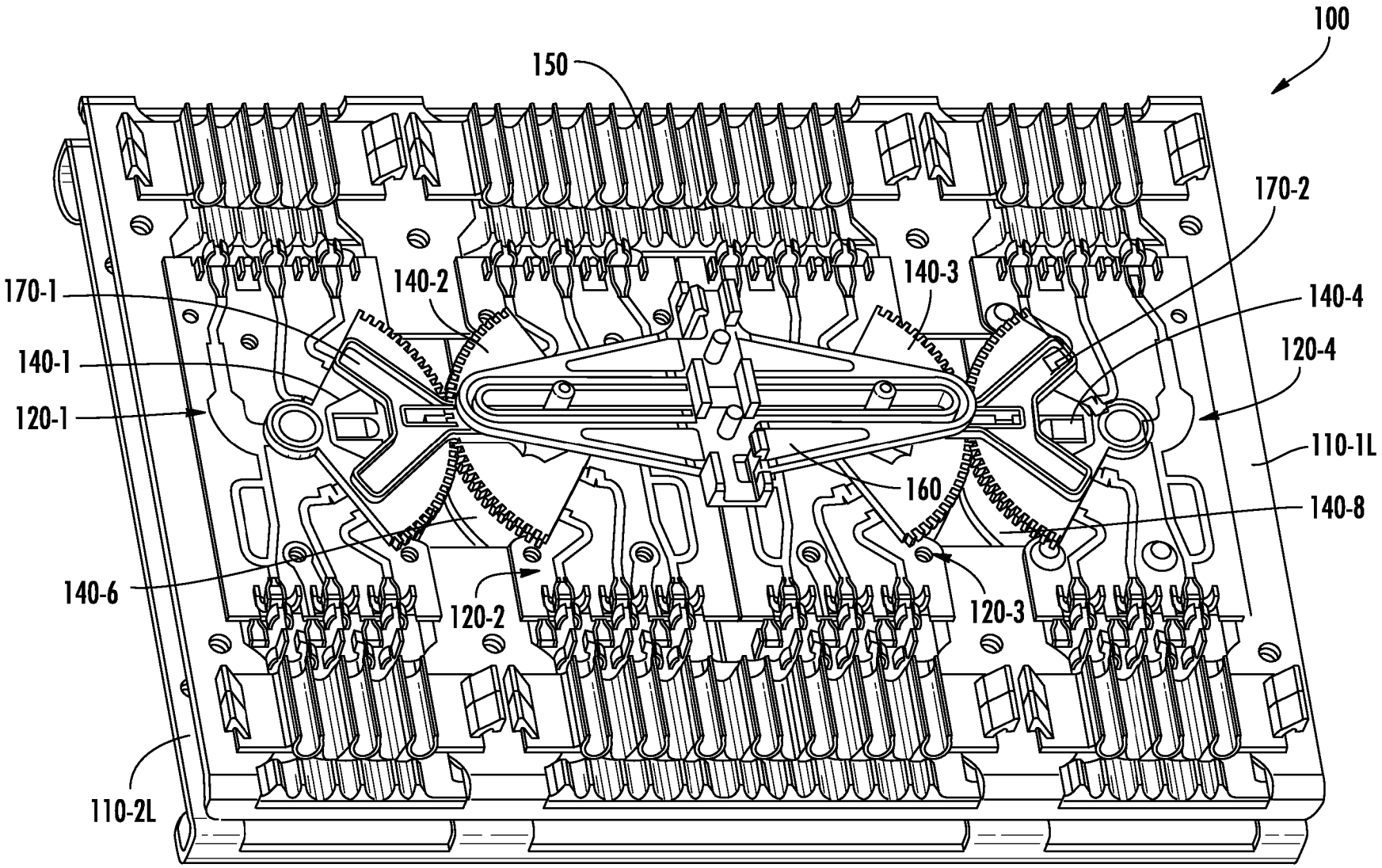
FIG. 1D is a perspective view of a phase shifter assembly for a base station antenna according to embodiments of the present inventive concepts.

FIG. 1D is a perspective view of a phase shifter assembly 100 for a base station antenna according to embodiments of the present inventive concepts. As with the example of FIG. 1C, FIG. 1D illustrates that a portion of the phase shifter support 140-1 is beside and interlocked with a portion of the phase shifter support 140-2, and a portion of the phase shifter support 140-3 is beside and interlocked with a portion of the phase shifter support 140-4. The phase shifter supports 140-2 and 140-3 are between the phase shifter supports 140-1 and 140-4. The linkages 170-1 and 170-2 that connect the phase shifter supports 140-1 and 140-4, respectively, to the linkage 160 are also illustrated. Moreover, the linkage 180 of FIGS. 1A-1C may be incorporated into the example of FIG. 1D and connected to the linkage 160.

FIG. 1D further illustrates that the phase shifters 120-2 and 120-3 may have respective coplanar surfaces that are adjacent each other and are served by a shared cable connector segment 150. For example, the shared cable connector segment 150 may be a cable clip that holds six RG402 cables. The shared cable connector segment 150 may decrease the distance between cables that are connected to different respective phase shifters 120, and thus may help reduce the overall size of the phase shifter assembly 100.

Moreover, FIG. 1D illustrates that the phase shifter supports 140-2 and 140-3 may have opposite orientations. For example, the phase shifter support 140-2 may face (and interlock with) the phase shifter support 140-1 to the left, whereas the phase shifter support 140-3 may face (and interlock with) the phase shifter support 140-4 to the right.

Figure 1E:
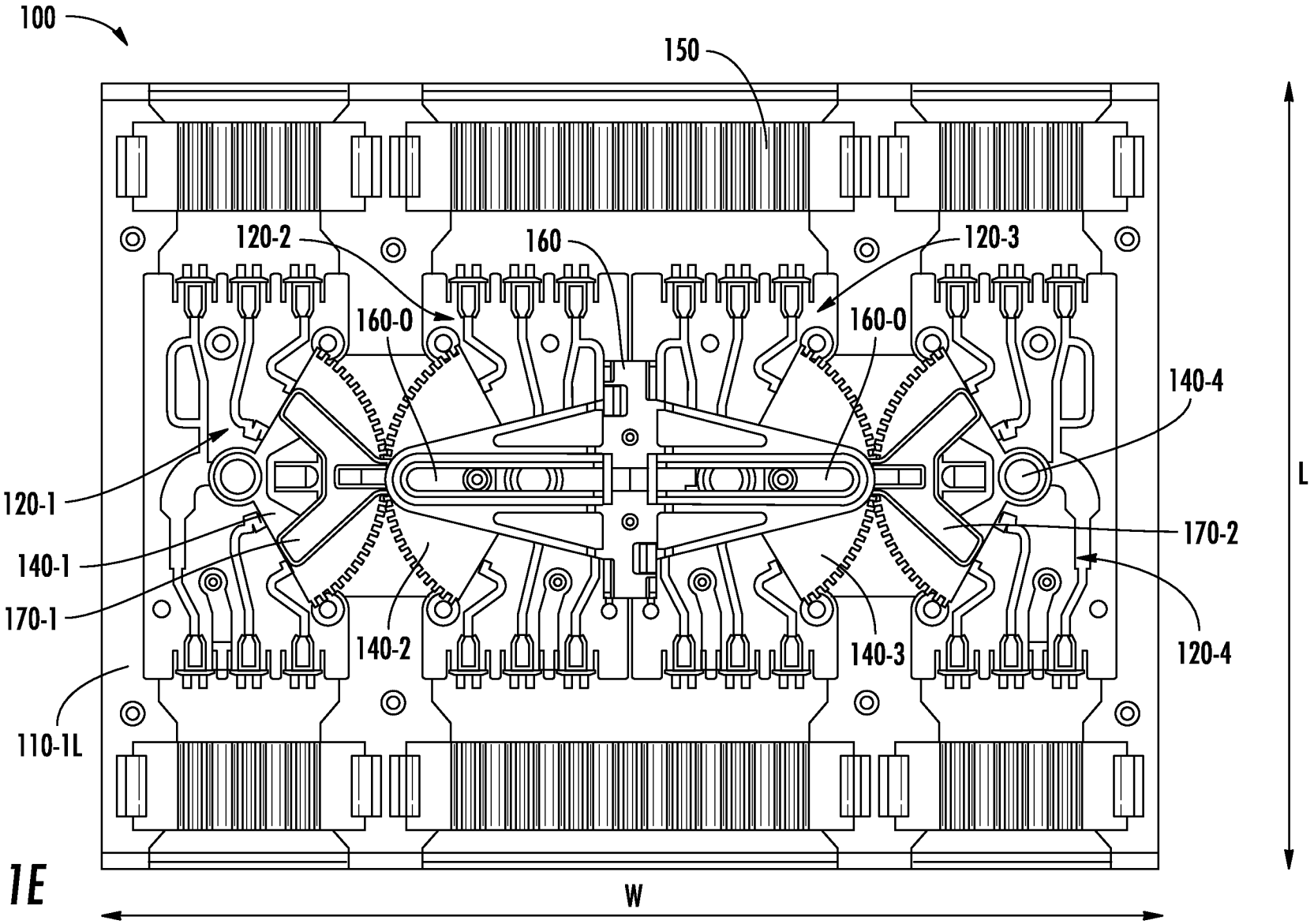
FIG. 1E is a plan view of a phase shifter assembly for a base station antenna according to embodiments of the present inventive concepts.

FIG. 1E is a plan view of a phase shifter assembly 100 for a base station antenna according to embodiments of the present inventive concepts. In particular, FIG. 1E is a plan view of the phase shifter assembly 100 of FIG. 1D. FIG. 1E illustrates that the phase shifters 120-1 and 120-2 may be a mirror-image pair of the phase shifters 120. Similarly, the phase shifters 120-3 and 120-4 may be a mirror-image pair of the phase shifters 120. For example, the movable portion (which is under the phase shifter support 140-1) of phase shifter 120-1 is on the right side of the phase shifter 120-1, whereas the movable portion (which is under the phase shifter support 140-2) of the phase shifter 120-2 is on the left side of the phase shifter 120-2. Also, the linkage 160 may include one or more openings 160-0 (e.g., slots) that are configured to receive portions of the linkages 170-1 and 170-2.

As illustrated in FIG. 1E, the phase shifter assembly 100 may have a width W and a length L. The length L may be determined primarily by the length of the phase shifters 120. In some embodiments, the phase shifters 120 may be phase shifters having a length of about 157 mm. Accordingly, the length L of the phase shifter assembly 100 may be 160 mm or smaller (e.g., 158.6 mm or smaller). Moreover, by using a mirror-image arrangement of the phase shifters 120 in which adjacent ones of the phase shifter supports 140 face each other, the width W of the phase shifter assembly 100 may be 220 mm or smaller (e.g., 214 mm or smaller). Also, a vertical depth/thickness of the phase shifter assembly 100 may be 50 mm or smaller (e.g., 48 mm or smaller).

Figure 1F:
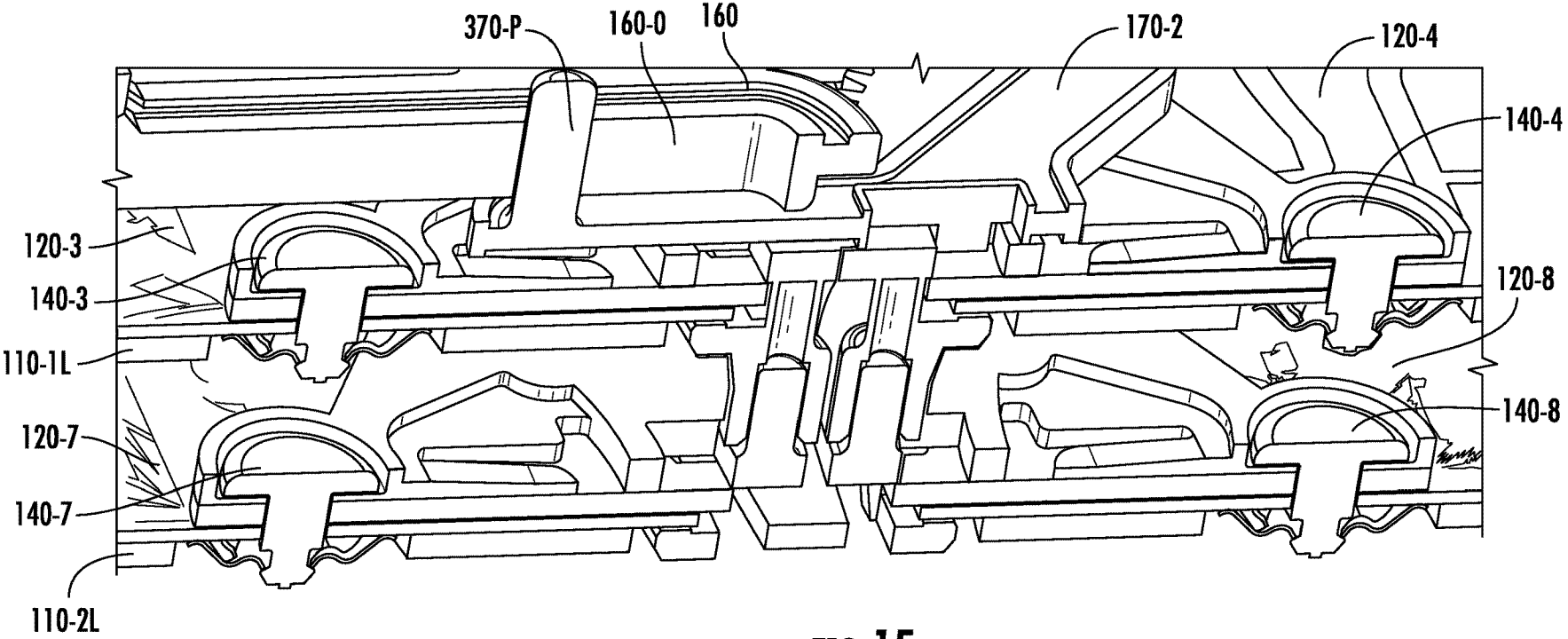
FIG. 1F is a cross-sectional view of a portion of a phase shifter assembly for a base station antenna according to embodiments of the present inventive concepts.

FIG. 1F is a cross-sectional view of a portion of a phase shifter assembly 100 for a base station antenna according to embodiments of the present inventive concepts. Specifically, FIG. 1F illustrates a portion of the phase shifter assembly 100 of FIG. 1D that includes portions of the linkage 170-2, the linkage 160, and the phase shifter supports 140-3, 140-4, 140-7, and 140-8. As illustrated in FIG. 1F, the phase shifter supports 140-3 and 140-4, which are on the first level 110-1L, may overlap and be connected to the phase shifter supports 140-7 and 140-8, respectively, that are on the second level 110-2L. Moreover, the linkage 160 may connect to the linkage 170-2 via an opening 160-0 (e.g., a slot) in the linkage 160. For example, a protruding portion 370-P (FIG. 3C) of the linkage 170-2 may extend into the opening 160-0. As a result, movement of the linkage 160 may drive movement of the linkage 170-2, which results in rotational movement of the phase shifter support 140-4.

FIGS. 2A and 2B are schematic block diagrams of two phase shifters 120 that are coupled to each other via respective wiper supports 140 according to embodiments of the present inventive concepts. Each phase shifter 120 of FIGS. 1A-1F may include a main PCB 230, which is stationary, and a wiper PCB 223, which is movable/rotatable. For example, FIG. 2A illustrates that the phase shifter 120-1 may include a main PCB 230-1 and a wiper PCB 223-1. Similarly, the phase shifter 120-2 may include a main PCB 230-2 and a wiper PCB 223-2. Each wiper PCB 223 may be configured to provide a sweep (i.e., degrees of angular rotation) of up to +/−37° from mid tilt.

Moreover, each wiper PCB 223 may be under a phase shifter support 140 of FIGS. 1A-1F. For example, the wiper PCBs 223-1 and 223-2 may be under the phase shifter supports 140-1 and 140-2, respectively. As discussed herein with respect to FIGS. 1A-1F, the phase shifter supports 140-1 and 140-2 may be coupled to (e.g., interlocked with) other. Accordingly, the wiper PCBs 223-1 and 223-2 may be moved/rotated by moving/rotating the phase shifter supports 140-1 and 140-2, respectively, thus adjusting the phase shifters 120-1 and 120-2.

Referring to FIG. 2B, the wiper PCBs 223-1 and 223-2 may be on the same shared main PCB 230-S. In particular, the shared main PCB 230-S may include two, three, four, or more wiper PCBs 223. The shared main PCB 230-S is a single, continuous main PCB that is in the housing 110, whereas the main PCBs 230-1 and 230-2 are individual, separate main PCBs that are beside each other in the housing 110.

Accordingly, a mirror-image pair of wiper PCBs 223-1 and 223-2 may be on the shared main PCB 230-S. The phase shifter supports 140-1 and 140-2 may connect to (or otherwise align with) pivot holes in the shared main PCB 230-S. This may increase accuracy (e.g., tilt accuracy) when adjusting the phase shifters 120-1 and 120-2, by helping to control the distance between the phase shifters 120-1 and 120-2 so that gear teeth 340-GT (FIG. 3A) of the phase shifter support 140-1 mesh properly with gear teeth 340-GT of the phase shifter support 140-2. The linkage 180 may drive the phase shifter 120-1 via its phase shifter support 140-1, which has the gear teeth 340-GT that may, as a result, directly (e.g., without any intervening component) drive the gear teeth 340-GT of the adjacent phase shifter support 140-2.

FIG. 2C is a schematic cross-sectional view of a phase shifter assembly 100 for a base station antenna according to embodiments of the present inventive concepts. In particular, FIG. 2C illustrates a vertical stack that includes the wiper PCB 223-1 on the main PCB 230-1, and the wiper support 140-1 on the wiper PCB 223-1, on the first level 110-1L of the housing 110. Similarly, the wiper PCBs 223-2, 223-3, and 223-4 are on the main PCBs 230-2, 230-3, and 230-4, respectively, and the wiper supports 140-2, 140-3, 140-4 are on the wiper PCBs 223-2, 223-3, and 223-4, respectively. FIG. 2C also illustrates that the linkages 170-1 and 170-2, which are coupled to the linkage 160, are on the wiper supports 140-1 and 140-4, respectively.

Moreover, the linkage 180 is connected to the linkage 160, and the first level 110-1L may be on top of the second level 110-2L. The wiper PCBs 223-5, 223-6, 223-7, and 223-8 are on the main PCBs 230-5, 230-6, 230-7, and 230-8, respectively, and the wiper supports 140-5, 140-6, 140-7, and 140-8 are on the wiper PCBs 223-5, 223-6, 223-7, and 223-8, respectively, on the second level 110-2L. The linkages 170-3 and 170-4, which may be coupled to the linkage 160, are shown on the wiper supports 140-5 and 140-8, respectively. In some embodiments, however, the linkages 170-3 and 170-4 may be omitted from the phase shifter assembly 100. Also, the wiper supports 140-1, 140-2, 140-3, and 140-4 of the first level 110-1L overlap the wiper supports 140-5, 140-6, 140-7, and 140-8, respectively, of the second level 110-2L.

The housing 110 may be a metal housing, such as a stamped sheetmetal housing, and may thus serve as an RF shield. As an alternative to stamped sheetmetal, a die-cast or metal injection molded part may be used for the housing 110. The housing 110 may include two regions/levels 110-1L and 110-2L that accommodate multiple groups of phase shifters 120 so that the combination of phase shifters 120 may share a common housing 110 and can be collectively adjusted by the linkage 180.

As illustrated in FIG. 2C, the two inner/middle main PCBs 230-2 and 230-3 are closer to each other than to the outer main PCBs 230-1 and 230-4. Similarly, the two inner/middle main PCBs 230-6 and 230-7 are closer to each other than to the outer main PCBs 230-5 and 230-8. For example, in some embodiments, the main PCBs 230-2 and 230-3 may contact each other, and the main PCBs 230-6 and 230-7 may contact each other. The main PCBs 230-2 and 230-3 are horizontally spaced apart, however, from the main PCBs 230-1 and 230-4, respectively, and the main PCBs 230-6 and 230-7 are horizontally spaced apart from the main PCBs 230-5 and 230-8, respectively.

The wiper PCBs 223 and the wiper supports 140 thereon may protrude horizontally beyond respective edges of the underlying main PCBs 230. Moreover, the portions of the phase shifters 120 that are illustrated in FIGS. 1C-1F may be the main PCBs 230, and the wiper PCBs 223 may be under the wiper supports 140 of FIGS. 1C-1F. Also, as discussed with respect to FIG. 2B, two, three, four or more of the wiper PCBs 223 may, in some embodiments, be on the same shared main PCB 230-S rather than on individual main PCBs 230.

The wiper supports 140 may be between the phase shifters 120 and a surface of the housing 110 that faces a conductive trace of the main PCBs 230 of the phase shifters 120. For example, the wiper supports 140 may be flexible components that are on the wiper PCBs 223 of the phase shifters 120 to bias the wiper PCBs 223 against the main PCBs 230. As an example, the wiper supports 140 may be made of plastic. Each phase shifter 120 may be driven by using its wiper PCB 223 as a wiper on its main PCB 230 and driving the wiper support 140 that is on the wiper PCB 223.

Figure 3A:
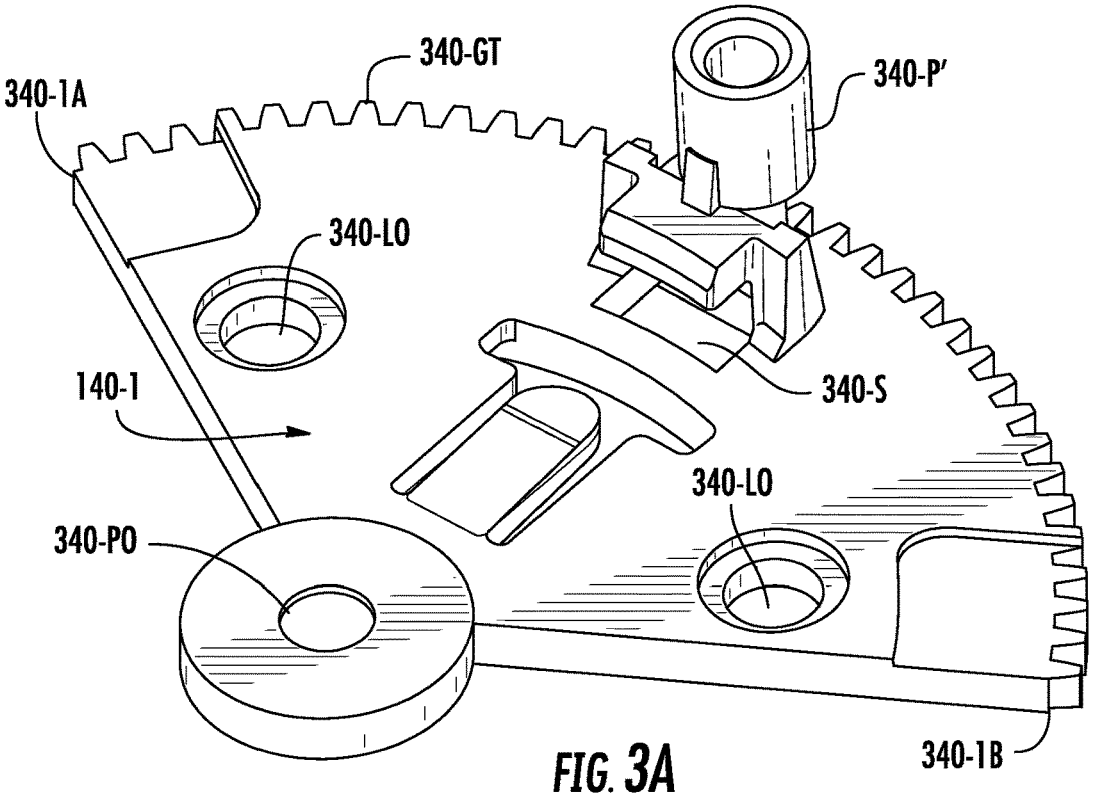
FIG. 3A is a view of a wiper support having gear teeth according to embodiments of the present inventive concepts.

FIG. 3A is a view of a wiper support 140-1 having a plurality of gear teeth 340-GT according to embodiments of the present inventive concepts. Although the wiper support 140-1 is provided as an example, any of the wiper supports 140-1, 140-2, 140-3, and 140-4 may have respective pluralities of gear teeth 340-GT. In particular, a portion of the gear teeth 340-GT of the wiper support 140-1 may be interlocked with a portion of the gear teeth 340-GT of the wiper support 140-2, and a portion of the gear teeth 340-GT of the wiper support 140-3 may be interlocked with a portion of the gear teeth 340-GT of the wiper support 140-4. Specifically, two wiper supports 140 for two mirror-image phase shifters 120, respectively, mesh/interlock together, thus allowing both of the phase shifters 120 to be driven by applying force for rotational movement to just one of the wiper supports 140.

As used herein with respect to the gear teeth 340-GT, the terms "interlock," "mesh," and "engage" may refer to contact between (a) at least one gear tooth tip (i.e., a protrusion) of the gear teeth 340-GT of one wiper support 140 and (b) at least one gear tooth root of the gear teeth 340-GT of another wiper support 140. The "tip" and the "root" can be, for example, the upper ⅓ and the lower ⅔, respectively, of a gear tooth. Additionally or alternatively, the terms "interlock," "mesh," and "engage" may refer to (a) at least one gear tooth tip/peak of the gear teeth 340-GT of one wiper support 140 extending into (b) at least one gear tooth notch of the gear teeth 340-GT of another wiper support 140. The "notch" is the opening/gap between adjacent teeth.

Each of the wiper supports 140-1, 140-2, 140-3, and 140-4 may include an alignment marker (e.g., an arrow or other indicator) 340-AM (FIG. 3E) that facilitates alignment of one set of gear teeth 340-GT with another set of gear teeth 340-GT during setup/assembly of the phase shifter assembly 100. For example, the alignment marker 340-AM on a particular wiper support 140 may point to a notch or a tooth of the gear teeth 340-GT of that wiper support 140.

As illustrated in FIG. 3A, the gear teeth 340-GT may extend clockwise from a first edge/point 340-1A of a portion (e.g., a curved surface) of the wiper support 140 to a second edge/point 340-1B of the portion of the wiper support 140. For example, the gear teeth 340-GT may extend less than 360 degrees (or even less than 180 degrees) around a perimeter of the wiper support 140. As an example, the gear teeth 340-GT may be built into an edge of the wiper support 140 that subtends an arc angle of about 80 degrees.

Additionally or alternatively to having the gear teeth 340-GT, one or more of the wiper supports 140-1, 140-2, 140-3, and 140-4 may have a protruding portion 340-P'. The protruding portion 340-P' may be configured to connect with a linkage 160 or 170 or with one of the wiper supports 140-5, 140-6, 140-7, or 140-8. Alternatively, the protruding portion 340-P' may be omitted. By omitting the protruding portion 340-P', the wiper supports 140-1, 140-2, 140-3, and 140-4 may better accommodate the linkages 170.

Moreover, each of the wiper supports 140-1, 140-2, 140-3, and 140-4 may have a pivot opening 340-PO, one or more openings/slots 340-S, and/or one or more linkage openings 340-LO. The pivot opening 340-PO, the opening(s)/slot(s) 340-S, and/or the linkage opening(s) 340-LO may be circular, square, elliptical, or other shapes. As an example, the pivot opening 340-PO, the opening(s)/slot(s) 340-S, and/or the linkage opening(s) 340-LO may include a socket feature (e.g., a keyed shaft socket feature). In some embodiments, the pivot opening 340-PO, the opening(s)/slot(s) 340-S, and/or the linkage opening(s) 340-LO may be configured to receive (and thus to connect with) a portion of a wiper PCB 223, a portion of a linkage 160 or 170, or a portion of one of the wiper supports 140-5, 140-6, 140-7, or 140-8. A wiper support 140 may pivot around an axis that extends through the pivot opening 340-PO, thus moving the gear teeth 340-GT of the wiper support 140, and moving the phase shifter 120 that underlies the wiper support 140.

It may be advantageous to increase the distance of movement of the linkage 180 relative to a wiper PCB 223 underlying a wiper support 140. For example, the longer the distance that the linkage 180 moves relative to the wiper PCB 223, the lower the force that is required from an actuator connected to the linkage 180 to move the wiper PCB 223. Also, the longer the distance that the linkage 180 moves relative to the wiper PCB 223, the smaller the impact that a given level of hysteresis of the linkage 180 has on antenna tilt position. For example, if the distance moved by the linkage 180 to provide a down tilt of 10 degrees is 60 mm, then the amount of movement is 6 mm per degree of down tilt and a hysteresis error of 2 mm of the linkage 180 results in 0.33 degrees of down tilt error. On the other hand, if the movement is 20 mm (which is ⅓ of 60 mm) for a down tilt of 10 degrees, then the same 2 mm of hysteresis error of the linkage 180 results in triple the down tilt error: 1 degree.

Accordingly, embodiments of the present inventive concepts lengthen the movement of the linkage 180 relative to the wiper PCB 223 by using a relatively long distance between a pivot point/axis of the wiper PCB 223 and a position of a pin (or other connection) to the linkage 160 that is driven by the linkage 180. As an example, a protruding portion 370-P (FIG. 3C) of a lever linkage 170 may connect the linkage 160 to a wiper PCB 223 whose pivot point/axis is relatively distant from the protruding portion 370-P. Moreover, the pivot point/axis of the wiper PCB 223 is overlapped by the pivot opening 340-PO of a corresponding wiper support 140.

The present inventive entity further appreciates that the gear teeth 340-GT of the wiper supports 140-1, 140-2, 140-3, and 140-4 may enable a phase shifter assembly 100 to have +/−1 degree of main beam tilt accuracy or better. This may include RF phase variations (e.g., via a phase cable trim process and/or feed network matching) of +/−0.5 degrees or better and mechanical variations (e.g., via RET positioning and/or a linkage system) of +/−0.5 degrees or better. For example, a +/−0.5 degree main beam pointing angle may necessitate an arc length on a phase shifter 120 outer arc of +/−1.26 mm. By including phase shifters 120 having wiper supports 140 with gear teeth 340-GT, the phase shifter assembly 100 according to embodiments of the present inventive concepts may achieve a width that is smaller than 220 mm (e.g., 214 mm or smaller) and/or may provide a tilt accuracy of +/−0.5 degrees or better.

Figure 3B:
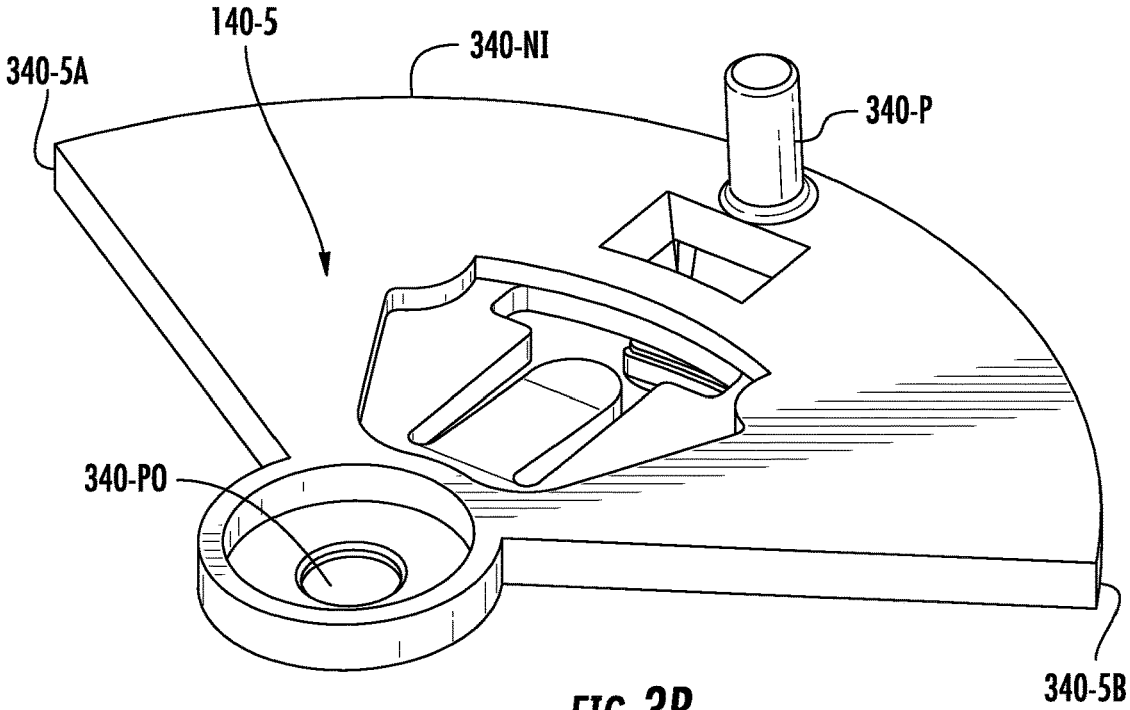
FIG. 3B is a view of a wiper support that is free of gear teeth according to embodiments of the present inventive concepts.

FIG. 3B is a view of a wiper support 140-5 that is free of gear teeth (e.g., the gear teeth 340-GT of FIG. 3A) according to embodiments of the present inventive concepts. Although the wiper support 140-5 is provided as an example, any of the wiper supports 140-5, 140-6, 140-7, and 140-8 may be free of gear teeth.

In particular, a portion (e.g., a nearest portion) of the wiper support 140-5 that is beside the wiper support 140-6 may be non-interlocking with the wiper support 140-6. Similarly, the wiper support 140-7 may be non-interlocking with the wiper support 140-8. For example, the wiper supports 140-5, 140-6, 140-7, and 140-8 may include respective curved, non-interlocking surfaces 340-NI. Specifically, the curved, non-interlocking surface 340-NI of the wiper support 140-5 may face the curved, non-interlocking surface 340-NI of the wiper support 140-6, and the curved, non-interlocking surface 340-NI of the wiper support 140-7 may face the curved, non-interlocking surface 340-NI of the wiper support 140-8.

Moreover, each of the wiper supports 140-5, 140-6, 140-7, and 140-8 may have one or more protruding portions (e.g., pins) 340-P. Each protruding portion 340-P may connect with (e.g., fit inside) an opening/slot 340-S of an overlying one of the wiper supports 140-1, 140-2, 140-3, and

140-4. Accordingly, the wiper supports 140-1, 140-2, 140-3, and 140-4 may be upper wiper supports that drive (e.g., directly drive) the wiper supports 140-5, 140-6, 140-7, and 140-8, which may be lower wiper supports. Moreover, as an alternative to using the built-in protruding portions 340-P of the lower wiper supports 140, separate pins may be connected to openings/sockets in both the upper and lower wiper supports 140, thus allowing the upper wiper supports 140 to drive the lower wiper supports 140 yet simplifying the manufacturing process of the upper and lower wiper supports 140 by making them more similar to each other.

Each lower wiper support 140 may therefore be fixed relative to an overlying upper wiper support 140 so that the upper wiper support 140 can drive the lower wiper support 140, and the connection/mechanism for such fixing may be built-in to the wiper supports 140 or provided as a separate component. For example, the lower wiper support 140 may be fixed relative to the upper wiper support 140 via a bolt, a screw, a latch, glue, a bump that fits in a recess, or a pin-and-socket (or pin-in-slot) connection. Alternatively, the linkage 160 may be a bi-level slotted linkage that connects to, and transfers movement to, both the upper and lower wiper supports 140 without using the upper wiper supports 140 to drive the lower wiper supports 140.

Figure 3C:
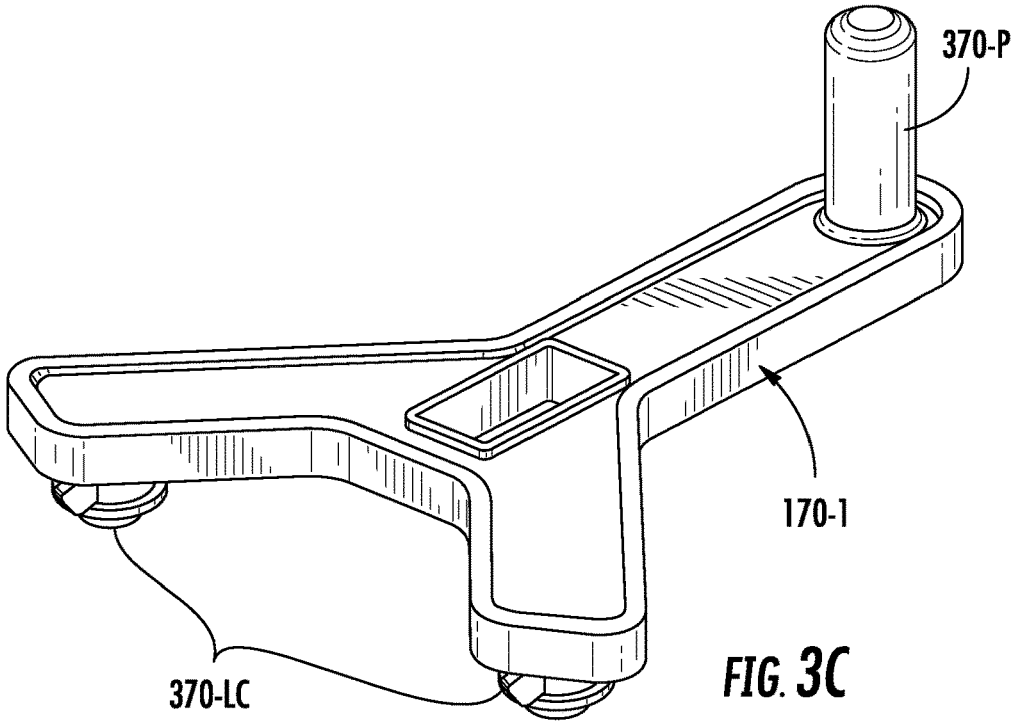
FIG. 3C is a view of a lever linkage according to embodiments of the present inventive concepts.

FIG. 3C is a view of a lever linkage 170-1 according to embodiments of the present inventive concepts. Although the linkage 170-1 is provided as an example, any of the linkages 170-1, 170-2, 170-3, and 170-4 may include one or more protruding portions (e.g., pins) 370-P and/or one or more linkage connectors 370-LC. Each protruding portion 370-P may connect to (e.g., fit inside) the linkage 160, whereas each linkage connector 370-LC may connect to (e.g., fit inside) a linkage opening 340-LO of one of the wiper supports 140-1, 140-2, 140-3, and 140-4.

Accordingly, in some embodiments, the lever linkages 170 may have pins 370-P that fit in respective slots (e.g., respective ones of the openings 160-0) of the linkage 160. An advantage of such a pin-in-slot mechanism is that the slots are typically longer than required, which allows some flexibility in the distance between the phase shifters 120. Moreover, if the lever linkages 170, which may be "lever arms," are sufficiently long, then hysteresis inherent in the pin and slot may be reduced/negligible.

As an alternative to a pin-in-slot mechanism, a rack-and-pinion system may be used. A one-sided rack from a gear box may already be present in the phase shifter assembly 100. Moreover, in some embodiments, a rack with teeth on two sides may be used. In this case, a linkage 170 may be a greater-than-80-degree section of a circular gear. An advantage of the rack-and-pinion mechanism is that the force efficiency may be excellent regardless of the wiper PCB 223 position. A fixed design of the gears, however, may limit/prevent flexibility with respect to spacing of the phase shifters 120, unless two one-sided racks are used instead of a single two-sided rack.

In either case (pin-in-slot or rack-and-pinion), the use of a separate part for the lever linkage 170 may be advantageous. For example, transferring a drive force to the wiper support 140 via the lever linkage 170 may reduce/prevent twist, which may reduce friction between the wiper support 140 and its underlying phase shifter 120. Also, the wiper support 140 can be designed to provide the correct rigidity for holding the wiper PCB 223 in place, and the lever linkage 170 can then be separately designed with the correct amount of rigidity for that function.

The lever linkages 170 allow a single slotted linkage 160 to be used to adjust all eight phase shifters 120-1, 120-2, 120-3, 120-4, 120-5, 120-6, 120-7, and 120-8. Each lever linkage 170 may mate to a wiper support 140 of an outboard phase shifter 120 (i.e., 120-1, 120-4, 120-5, or 120-8) through a keyed/snap-in feature. The lever linkage 170 may also hook into a slotted part of the slotted linkage 160.

The lever linkage 170 also allows a pin (e.g., the protruding portion 370-P of the lever linkage 170) that connects to the slotted linkage 160 to be farther from the pivot point/axis of a wiper PCB 223. As such, the lever linkage 170 reduces force and increases accuracy by lengthening the throw range, without having to increase the size of the wiper support 140 and without having to increase the distance between the phase shifters 120. For example, due to limitations of a motor that drives the linkage 180, it may be desirable to keep the force used by the motor relatively low. As an example, the motor may be designed to operate at temperatures as low as −40° C. or −50° C., and using relatively high force at such temperatures may damage or wear out the motor. The lever linkages 170, however, may be relatively long and thus may reduce the force needed to move the wiper PCBs 223 of the outboard phase shifters 120 (and thus the wiper PCBs 223 of the inboard phase shifters 120 (e.g., 120-2 and 120-3) that are driven via the wiper supports 140 of the outboard phase shifters 120).

The lever linkages 170 connect to the outboard phase shifters 120 because the outboard phase shifters 120 are the farthest phase shifters 120 from the linkage 180, which may be a central drive rod. The pins (e.g., the protruding portions 370-P) of the lever linkages 170 that connect to the slotted linkage 160 can thus be relatively far from the pivot points/axes of the outboard phase shifters 120, while also keeping the pins relatively close to the linkage 180, which may improve hysteresis. Accordingly, the lever linkages 170 may increase a ratio of (a) movement of the linkage 180 to (b) rotational movement of the wiper PCBs 223 of the outboard phase shifters 120, thus improving accuracy when performing phase shifts, as well as facilitating a compact design of the phase shifter assembly 100.

Figure 3D:
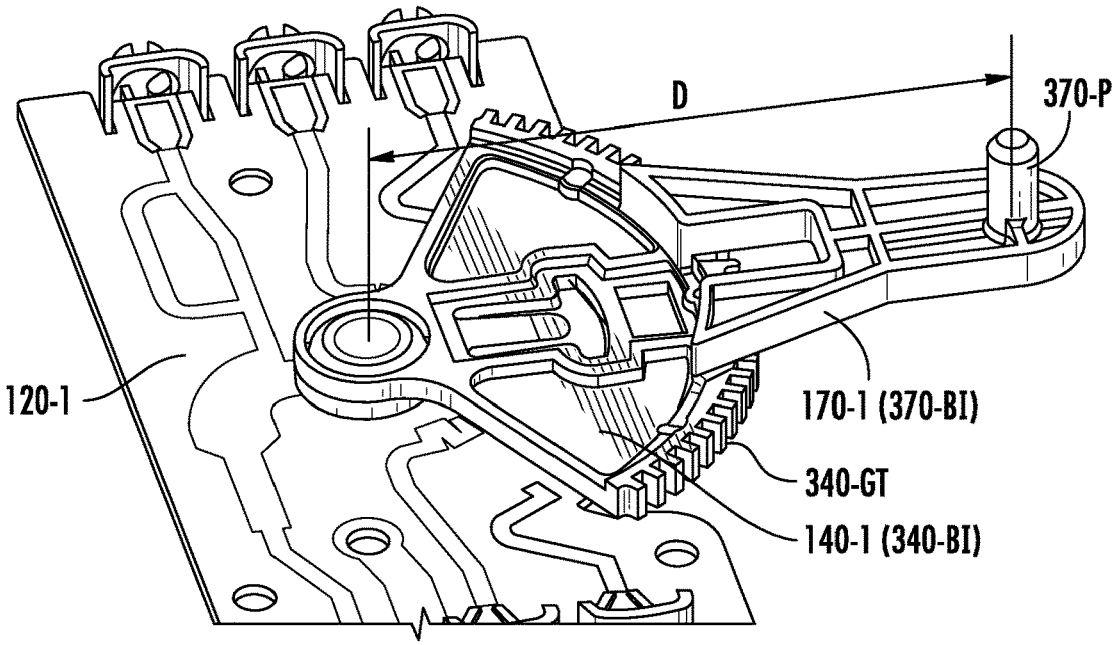
FIG. 3D is a view of a wiper support that includes a built-in lever linkage according to embodiments of the present inventive concepts.

FIG. 3D is a view of a wiper support 140-1 that includes a built-in (e.g., non-detachable) lever linkage 170-1. Accordingly, in some embodiments, a lever linkage 170 and a wiper support 140 may be a single part rather than two individual parts. In particular, as an alternative to forming the lever linkage 170 and the outboard wiper support 140 to which it will connect as two separate parts, the lever linkage 170 and the outboard wiper support 140 may be formed as a unitary component, thus eliminating the need to snap together (or otherwise attach) the lever linkage 170 and the outboard wiper support 140 to each other.

In embodiments in which the lever linkage 170-1 is a built-in portion of the wiper support 140-1, it may be identified as a built-in lever linkage 370-BI that is a portion of a wiper support 340-BI. For example, the lever linkage 170-1/370-BI of FIG. 3D is shown as a protruding portion of the wiper support 140-1/340-BI that protrudes beyond (and over) the gear teeth 340-GT. In particular, as the wiper support 140-1/340-BI is an outboard wiper support, the lever linkage 170-1/370-BI protrudes toward the linkage 160, to connect the wiper support 140-1/340-BI to the linkage 160.

Moreover, a distance D from (a) a portion 370-P of the lever linkage 170-1/370-BI that connects to the linkage 160 to (b) the pivot point/axis of the wiper support 140-1/340-BI may be designed/selected to improve the phase shifter assembly 100. For example, as the distance D increases, less push or pull force is needed to drive the phase shifters 120. Also, as the distance D increases, systematic accuracy can be improved for a given traveling range. Although the wiper support 140-1/340-BI is shown as an example in FIG. 3D, any of the outboard wiper supports 140-1, 140-4, 140-5, and/or 140-8 may include a built-in lever linkage 370-BI. Accordingly, any of the lever linkages 170-1, 170-2, 170-3, and/or 170-4 may be built-in lever linkages 370-BI.

Figure 3E:
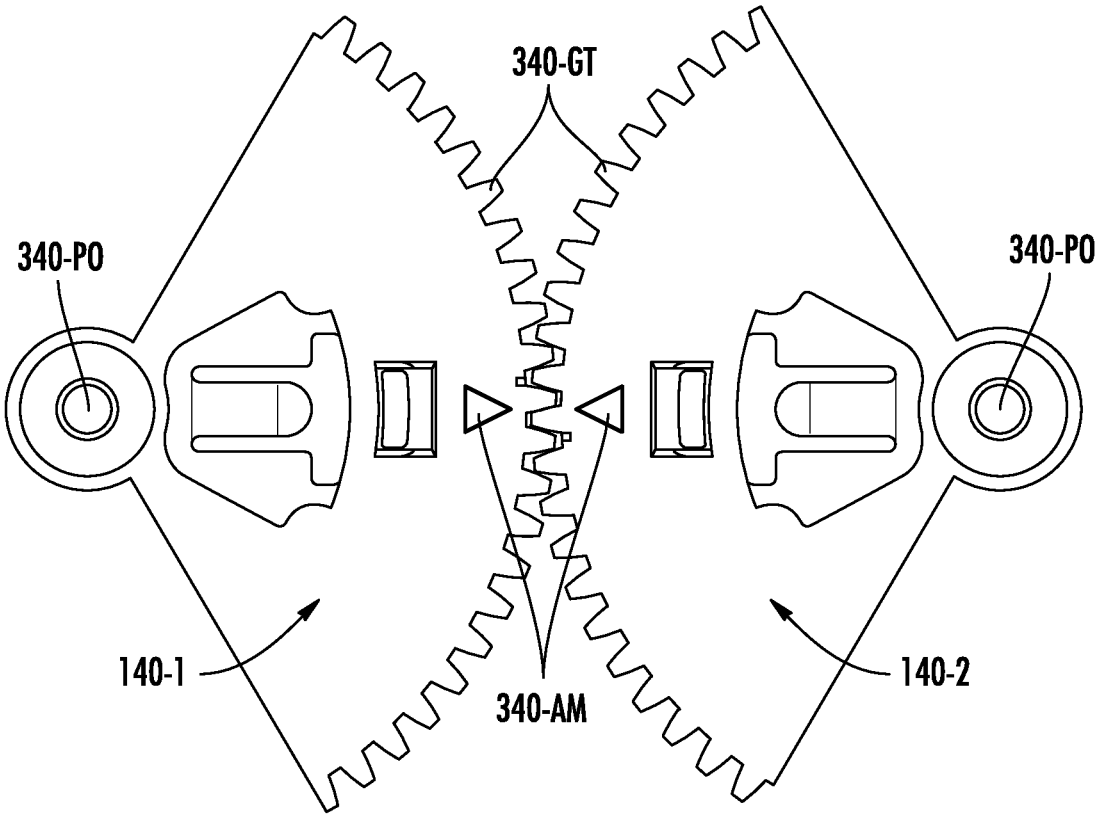
FIG. 3E is a view of a pair of wiper supports having gear teeth according to embodiments of the present inventive concepts.

FIG. 3E is a view of a pair of wiper supports 140-1 and 140-2 having gear teeth 340-GT. FIG. 3E illustrates a first side (e.g., the top side) of the pair of wiper supports 140-1 and 140-2, whereas FIG. 3A illustrates an opposite, second side (e.g., the bottom side) of the wiper support 140-1. As shown in the FIG. 3E, a portion of the gear teeth 340-GT of the wiper support 140-1 is interlocked with a portion of the gear teeth 340-GT of the wiper support 140-2. Moreover, the wiper supports 140-1 and 140-2 have respective alignment markers 340-AM that facilitate alignment of the gear teeth 340-GT of the wiper support 140-1 with the gear teeth 340-GT of the wiper support 140-2.

Figure 4:
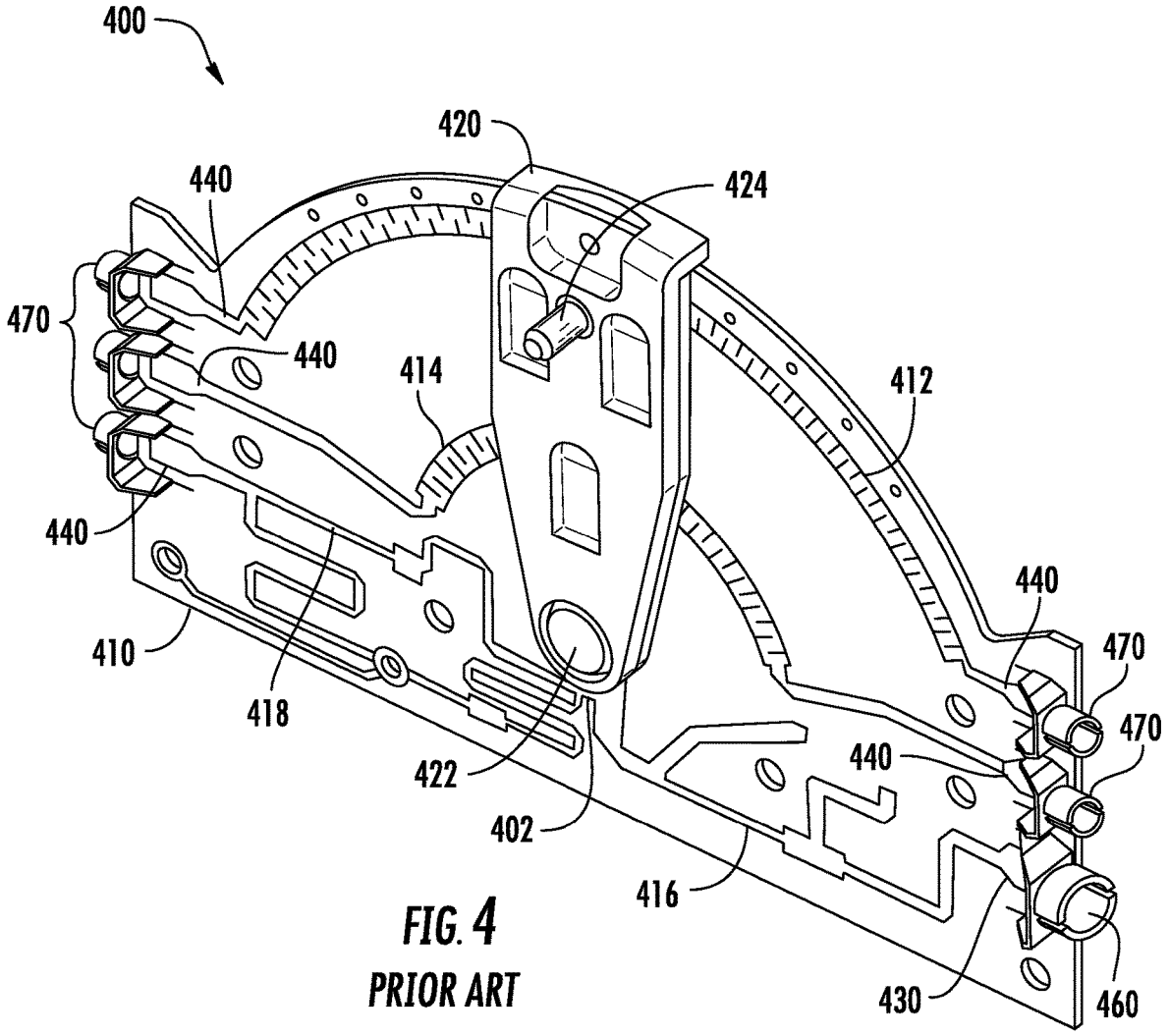
FIG. 4 PRIOR ART
FIG. 4 is a perspective view of a prior art electromechanical rotary wiper arc phase shifter.

FIG. 4 is a perspective view of a prior art electromechanical rotary wiper arc phase shifter 400. The electromechanical rotary wiper arc phase shifter 400 may be used to implement a power divider network and a phase shifter. As shown in FIG. 4, the phase shifter 400 includes a main (stationary) PCB 410 and a rotatable wiper PCB 420 that is rotatably mounted on the main PCB 410 via a pivot pin 422. The position of the rotatable wiper PCB 420 above the main PCB 410 is controlled by the position of a mechanical linkage that may connect, for example, to a post 424 on the wiper PCB 420. The other end of the mechanical linkage may be coupled to an RET actuator. For example, the mechanical linkage may be a rod, shaft, or the like that connects at one end to a piston (or other suitable mechanical translator) and connects at the other end to, for example, the wiper PCB 420 of a rotary wiper arc phase shifter 400.

The main PCB 410 includes a plurality of generally arcuate transmission line traces 412, 414. In some cases the arcuate transmission line traces 412, 414 may be in a serpentine pattern to achieve a longer effective length. In FIG. 4, there are two arcuate transmission line traces 412, 414, with the first arcuate transmission line trace 412 being disposed along an outer circumference of the main PCB 410 and the second arcuate transmission line trace 414 being disposed on a shorter radius concentrically within the outer transmission line trace 412. A third transmission line trace 416 on the main PCB 410 connects an input pad 430 on the main PCB 410 to a power divider 402. A first output of the power divider 402, which carries the majority of the power of any RF signal input at input pad 430, capacitively couples to a circuit trace on the wiper PCB 420. The second output of the power divider 402 connects to an output pad 440 via a transmission line trace 418. RF signals that are coupled to this output pad 440 are not subjected to an adjustable phase shift.

The wiper PCB 420 includes another power divider (on the opposite/rear side of wiper PCB 420) that divides the RF signals coupled thereto. One output of this power divider couples to a first pad on the wiper PCB 420 that overlies the transmission line trace 412, and the other output of this power divider couples to a second pad on the wiper PCB 420 that overlies the transmission line trace 414. The first and second pads capacitively couple the respective outputs of the power divider on the wiper PCB 420 to the respective transmission line traces 412, 414 on the main PCB 410. Each end of each transmission line trace 412, 414 may be coupled to a respective output pad 440.

A cable holder 460 may be provided adjacent the input pad 430 to facilitate connecting a coaxial cable or other RF transmission line component to the input pad 430. Respective cable holders 470 may be provided adjacent each of the output pads 440 to facilitate connecting additional coaxial cables or other RF transmission line components to each output pad 440. As the wiper PCB 420 moves, an electrical path length from the input pad 430 of phase shifter 400 to each radiating element in a base station antenna changes. For example, as the wiper PCB 420 moves to the left, it shortens the electrical length of the path from the input pad 430 to the output pad 440 connected to the left side of transmission line trace 412, while the electrical length from the input pad 430 to the output pad 440 connected to the right side of transmission line trace 412 increases by a corresponding amount. These changes in path lengths result in phase shifts to the signals received at the output pads 440 connected to transmission line trace 412 relative to, for example, the output pad 440 connected to transmission line trace 418. Thus, the phase shifter 400 may receive an RF signal at input pad 430, divide the RF signal into a plurality of sub-components, apply different amounts of phase shift to each sub-component, and output the phase-shifted sub-components on output pads 440.

One or more of the phase shifters 120 of FIGS. 1A-2C may be, or may include components of, the electromechanical rotary wiper arc phase shifter 400. For example, one or more of the main PCBs 230 may be the main PCB 410, and one or more of the wiper PCBs 223 may be the wiper PCB 420. The phase shifters 120 of the present inventive concepts are not limited, however, to the electromechanical rotary wiper arc phase shifter 400. Accordingly, in some embodiments, one or more of the phase shifters 120 may include features different from those of the electromechanical rotary wiper arc phase shifter 400.

The phase shifters 120 of the present inventive concepts may apply different amounts of phase shift via RF output ports. For example, the phase shifters 120 may collectively provide (i) 0° of phase shift, (ii) positive phase shifts of various magnitudes (e.g., +1°, +2° and +3°), and (iii) negative phase shifts of the same magnitudes (e.g., −1°, −2° and −3°). Moreover, the base station antenna may adjust each of the phase-shifted values (e.g., +1°, +2°, +3°, −1°, −2°, and −3°) by an equal amount (e.g., +x° or −x°) via the linkage 180 that is configured to collectively drive the phase shifters 120. Accordingly, if the adjustment is a positive value, then the adjusted phase shift values may be (+1°+x°), (+2°+x°), (+3°+x°), (−1°+x°), (−2°+x°), and (−3°+x°). Alternatively, if the adjustment is a negative value, then the adjusted phase shift values may be (+1°−x°), (+2°−x°), (+3°−x°), (−1°−x°), (−2°−x°), and (−3°−x°).

In contrast with the single phase shifter in FIG. 4, however, various embodiments described herein provide a plurality of individual phase shifters 120 in a phase shifter assembly 100. In particular, the phase shifters 120 may have an arrangement that efficiently uses space in the phase shifter assembly 100, and therefore provides a relatively compact design. Moreover, the phase shifters 120 may be driven as a group via a combination of linkages 160, 170, 180, and/or wiper supports 140, that reduce force, improve transmission accuracy, and allow a compact design.

Figure 5:
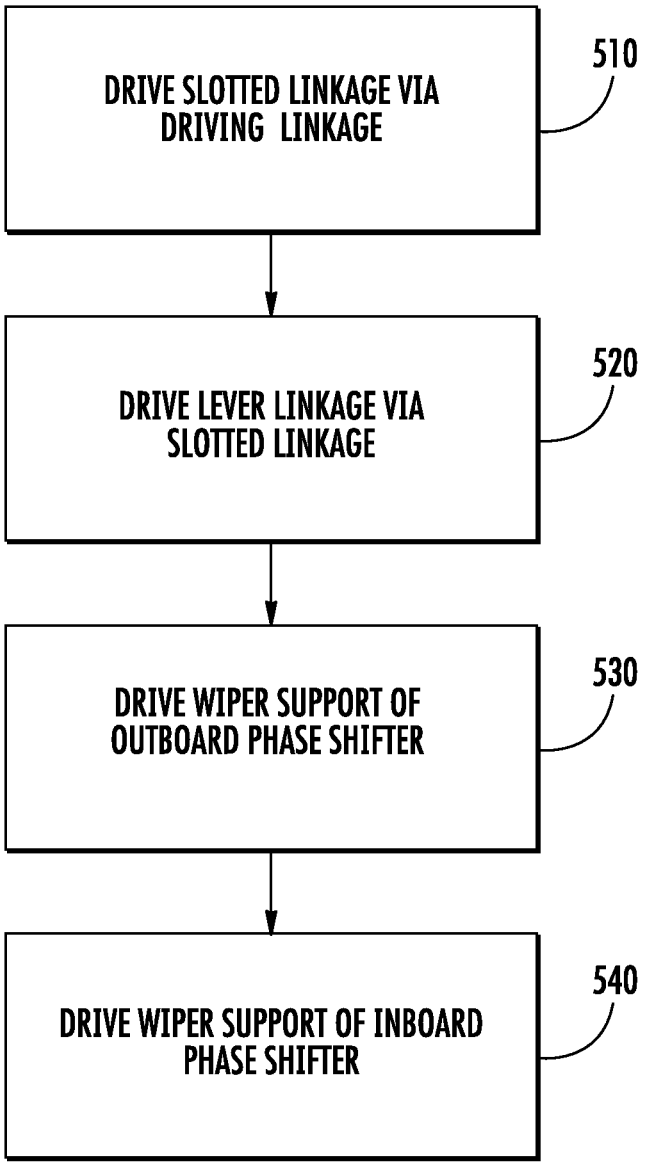
FIG. 5 is a flowchart illustrating operations of a base station antenna that includes a phase shifter assembly according to embodiments of the present inventive concepts.

FIG. 5 is a flowchart illustrating operations of a base station antenna that includes a phase shifter assembly 100. The operations may include driving (Block 510) a linkage 160 via a linkage 180. For example, a motor may cause movement of the linkage 180, which then drives the linkage 160. In response, the linkage 160 may drive (Block 520) a linkage 170 that is connected to a wiper support 140 that is on an outboard (or "outer") phase shifter 120. Accordingly, the operations may include driving (Block 530) rotational movement of the wiper support 140 that is on the outboard phase shifter 120, via the linkage 170. In some embodiments, a plurality of linkages 170 may connect wiper supports 140 to the linkage 160, and the operation(s) of Block 530 may thus include driving the wiper supports 140 of a plurality of outboard phase shifters 120. Because the wiper support(s) 140 of the outboard phase shifter(s) 120 may interlock with wiper support(s) 140 of inboard (or "inner") phase shifter(s) 120, the wiper support(s) 140 of the outboard phase shifter(s) 120 may drive (Block 540) rotational movement of the wiper support(s) 140 of the inboard phase shifter(s) 120. Moreover, because the wiper supports 140 are on wiper PCBs 223 of the phase shifters 120, the rotational movement of the wiper supports 140 results in rotational movement of the wiper PCBs 223.

Although FIG. 5 illustrates Blocks 510-540 as separate blocks, one or more of the blocks may be combined or omitted. For example, Blocks 530 and 540 may be combined (with or without Blocks 510 and 520) to provide a method that includes driving rotational movement of a first plurality of phase shifter wiper supports 140 of a plurality of inboard phase shifters 120, respectively, of a phase shifter assembly 100 by driving rotational movement of a second plurality of phase shifter wiper supports 140 of a plurality of outboard phase shifters 120, respectively, of the phase shifter assembly 100.

In some embodiments, Block 520 may be combined with Block 530 such that driving the rotational movement of the second plurality of phase shifter wiper supports 140 includes driving a plurality of lever linkages 170 that connect the second plurality of phase shifter wiper supports 140, respectively, to a slotted linkage 160 of the phase shifter assembly 100. Moreover, Blocks 510 and 520 may be combined such that driving the plurality of lever linkages 170 includes driving the slotted linkage 160 by operating a motor to drive a driving linkage 180 that is connected to the slotted linkage 160.

According to embodiments of the present inventive concepts, a linkage system including linkages 160, 170, and 180 may be configured to drive a plurality of phase shifters 120 by applying an equal amount of rotational movement to each phase shifter 120. Moreover, a wiper support 140 of one phase shifter 120 that is coupled to the linkage system may be configured to drive an adjacent wiper support 140 of another phase shifter 120 to achieve the same amount of rotational movement. In particular, the linkage 180 may be configured to drive the linkage 160, which may be configured to drive linkages 170 that are configured to drive wiper supports 140 of outboard phase shifters 120. The wiper supports 140 of the outboard phase shifters 120 are configured to drive wiper supports 140 of inboard phase shifters 120.

The arrangement of, and linkage system for, phase shifters 120 according to embodiments of the present inventive concepts may provide a number of advantages. These advantages include reducing the overall size of the phase shifter assembly 100. For example, the phase shifter assembly 100 may be 226 mm wide (in the longest dimension of the housing/structure 110) or, in some embodiments, even smaller than 220 mm wide. Because the design may be relatively small in size, it may accommodate single-band and/or multi-band antennas. The advantages also include reducing/preventing a phase discrepancy between different ones of the phase shifters 120. For example, the gear teeth 340-GT of the wiper supports 140 may keep the wiper supports 140 well-engaged and synchronized. Moreover, the advantages include reducing the force that is used to move a wiper PCB 223 and reducing down tilt error. As an example, the lever linkages 170 can reduce the push and pull force that is required to drive the wiper PCBs 223 and can improve transmission accuracy relative to conventional phase shifter assemblies.

The present inventive concepts have been described above with reference to the accompanying drawings. The present inventive concepts are not limited to the illustrated embodiments. Rather, these embodiments are intended to fully and completely disclose the present inventive concepts to those skilled in this art. In the drawings, like numbers refer to like elements throughout. Thicknesses and dimensions of some components may be exaggerated for clarity.

Spatially relative terms, such as "under," "below," "lower," "over," "upper," "top," "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the example term "under" can encompass both an orientation of over and under. The device may be otherwise oriented (rotated 90 degrees or at other orientations) and the spatially relative descriptors used herein interpreted accordingly.

Herein, the terms "attached," "connected," "interconnected," "contacting," "mounted," and the like can mean either direct or indirect attachment or contact between elements, unless stated otherwise.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the present inventive concepts. As used herein, the singular forms "a," "an," and "the" are intended to include the plural forms as well, unless the context clearly indicates otherwise. It will be further understood that the terms "comprises," "comprising," "includes," and/or "including" when used in this specification, specify the presence of stated features, operations, elements, and/or components, but do not preclude the presence or addition of one or more other features, operations, elements, components, and/or groups thereof.

That which is claimed is:

1. A base station antenna comprising:

a first wiper phase shifter, and a second wiper phase shifter that is beside the first wiper phase shifter;

a third wiper phase shifter, and a fourth wiper phase shifter that is beside the third wiper phase shifter;

first and second wiper supports on the first and second wiper phase shifters, respectively, the first wiper support comprising a portion that is beside and interlocked with a portion of the second wiper support;

third and fourth wiper supports on the third and fourth wiper phase shifters, respectively, wherein the third wiper support is beside and non-interlocking with the fourth wiper support;

a metal structure comprising different first and second levels, wherein the first and second wiper phase shifters are on the first level, and wherein the third and fourth wiper phase shifters are on the second level;

a fifth wiper phase shifter on the first level;

a fifth wiper support on the fifth wiper phase shifter; and a first linkage overlapping the second and fifth wiper phase shifters;

a second linkage that connects the first wiper support to the first linkage; and a third linkage that is connected to, and configured to control movement of, the first linkage wherein the first and second wiper supports overlap the third and fourth wiper supports, respectively.

2. The base station antenna of claim 1, wherein the portion of the first wiper support and the portion of the second wiper support comprise first and second pluralities of gear teeth, respectively, and wherein a portion of the first plurality of gear teeth is interlocked with a portion of the second plurality of gear teeth.

3. The base station antenna of claim 2, wherein the first and second pluralities of gear teeth are on first and second curved surfaces, respectively, of the first and second wiper supports.

4. The base station antenna of claim 3, wherein the first and second pluralities of gear teeth extend less than 360 degrees around the first and second wiper supports, respectively, and wherein the first wiper support comprises a built-in lever linkage portion that protrudes beyond the first plurality of gear teeth.

5. The base station antenna of claim 1, further comprising:

a sixth wiper phase shifter on the first level;

a sixth wiper support on the sixth wiper phase shifter, the sixth wiper support comprising a portion that is beside and interlocked with a portion of the fifth wiper support; and a fourth linkage that connects the sixth wiper support to the first linkage, wherein the second and fifth wiper phase shifters are between the first and sixth wiper phase shifters.

6. The base station antenna of claim 5, further comprising:

a seventh wiper phase shifter, and an eighth wiper phase shifter that is beside the seventh wiper phase shifter on the second level; and seventh and eighth wiper supports on the seventh and eighth wiper phase shifters, respectively, wherein the seventh wiper support is beside and non-interlocking with the eighth wiper support, wherein the fifth and sixth wiper supports overlap the seventh and eighth wiper supports, respectively.

7. The base station antenna of claim 1, further comprising a main Printed Circuit Board (PCB) having a Radio Frequency (RF) transmission line thereon, wherein the first and second wiper phase shifters comprise first and second wiper PCBs, respectively, that are mirror images of each other, and wherein the main PCB is part of at least one of the first wiper phase shifter or the second wiper phase shifter.

8. A base station antenna comprising:

a first wiper phase shifter, and a second wiper phase shifter that is coupled to the first wiper phase shifter;

a third wiper phase shifter;

a first linkage that is on the second and third wiper phase shifters; and a second linkage that intersects, and is coupled to, the first linkage and is configured to adjust the first, second, and third wiper phase shifters via the first linkage;

wherein the first and second wiper phase shifters comprise a mirror-image pair of wiper phase shifters;

wherein the second wiper phase shifter is between the first wiper phase shifter and the third wiper phase shifter;

wherein the base station antenna further comprises first, second, and third wiper supports on the first, second, and third wiper phase shifters, respectively; and wherein the first wiper phase shifter is coupled to the second wiper phase shifter via the first and second wiper supports.

9. The base station antenna of claim 8, further comprising:

a fourth wiper phase shifter that is beside the third wiper phase shifter;

a metal structure comprising a first level that comprises the first, second, third, and fourth wiper phase shifters;

fifth, sixth, seventh, and eighth wiper phase shifters on a second level of the metal structure, wherein the first level overlaps the second level; and fourth, fifth, sixth, seventh, and eighth wiper supports on the fourth, fifth, sixth, seventh, and eighth wiper phase shifters, respectively, wherein the second linkage is configured to adjust the first, second, third, fourth, fifth, sixth, seventh, and eighth wiper phase shifters by driving the first linkage.

10. The base station antenna of claim 9, further comprising:

a third linkage that couples the first wiper support to the first linkage; and a fourth linkage that couples the fourth wiper support to the first linkage, wherein the second and third wiper phase shifters are between the first and fourth wiper phase shifters.

11. The base station antenna of claim 9, wherein the first linkage comprises a slotted linkage, and wherein a portion of the second linkage is in a slot of the slotted linkage.

12. The base station antenna of claim 11, wherein the sixth wiper support comprises a protruding pin that is in a slot of the second wiper support.

13. The base station antenna of claim 11, wherein the slotted linkage comprises a multi-level slotted linkage that comprises a first portion on the first level and a second portion on the second level, wherein the second portion is on the sixth and seventh wiper phase shifters, and wherein the slot of the slotted linkage is between the first and second portions.

14. The base station antenna of claim 9, wherein the first, second, third, and fourth wiper supports comprise first, second, third, and fourth pluralities of gear teeth, respectively, wherein a portion of the first plurality of gear teeth is interlocked with a portion of the second plurality of gear teeth, and a portion of the third plurality of gear teeth is interlocked with a portion of the fourth plurality of gear teeth, wherein the fifth wiper support is beside and non-interlocking with the sixth wiper support, and wherein the seventh wiper support is beside and non-interlocking with the eighth wiper support.

* * * * *